US010625530B2

(12) United States Patent
Nelson

(10) Patent No.: US 10,625,530 B2
(45) Date of Patent: Apr. 21, 2020

(54) THEMED GIFT CARD AND GIFT CARD HOLDER COMBINATIONS AND PACKAGING THEREFOR

(71) Applicant: American Greetings Corporation, Cleveland, OH (US)

(72) Inventor: Gary Nelson, Avon, OH (US)

(73) Assignee: American Greetings, Cleveland, OH (US)

( * ) Notice: Subject to any disclaimer, the term of this patent is extended or adjusted under 35 U.S.C. 154(b) by 0 days.

(21) Appl. No.: 16/133,868

(22) Filed: Sep. 18, 2018

(65) Prior Publication Data

US 2019/0016168 A1 Jan. 17, 2019

Related U.S. Application Data

(62) Division of application No. 15/698,387, filed on Sep. 7, 2017, now abandoned.

(60) Provisional application No. 62/393,503, filed on Sep. 12, 2016.

(51) Int. Cl.

| | |
|---|---|
| ***B42D 15/02*** | (2006.01) |
| ***B65D 73/00*** | (2006.01) |
| ***B65D 5/42*** | (2006.01) |
| ***B65D 5/52*** | (2006.01) |
| ***B42F 7/02*** | (2006.01) |
| ***B42D 15/04*** | (2006.01) |
| ***B42F 7/06*** | (2006.01) |

(52) U.S. Cl.

CPC ..... *B42D 15/022* (2013.01); *B42D 15/045* (2013.01); *B42F 7/02* (2013.01); *B42F 7/06* (2013.01); *B65D 5/4204* (2013.01); *B65D 5/4233* (2013.01); *B65D 5/4258* (2013.01); *B65D 5/5213* (2013.01); *B65D 73/0007* (2013.01); *B65D 73/0092* (2013.01)

(58) Field of Classification Search

CPC ..... B42D 15/02; B42D 15/022; B42D 15/04; B42D 15/045; B42F 7/06; B65D 5/42; B65D 5/4204; B65D 5/4233; B65D 5/4258; B65D 5/52; B65D 5/5213; B65D 73/00; B65D 73/007; B65D 73/0092; G09F 1/00

USPC ..... 206/232, 461–471; 40/124.06

See application file for complete search history.

(56) References Cited

U.S. PATENT DOCUMENTS 3,811,563 A * 5/1974 Fox, II ..... B65D 43/162 206/459.5
4,291,807 A * 9/1981 Giordano ..... B65D 5/5435 206/470
4,360,106 A * 11/1982 Irvine ..... B65D 5/4208 206/470

(Continued)

*Primary Examiner* — Bryon P Gehman
(74) *Attorney, Agent, or Firm* — Christine Flanagan

(57) ABSTRACT

Various themed gift card and gift card holder combinations are disclosed. Some embodiments are contained inside a box along with novelty gift items that are themed or otherwise related to the type of gift card contained therein. Other embodiments contain various three-dimensional pop-up structures and other paper engineered constructs that are shaped, decorated and otherwise themed to match an accompanying gift card. And in yet other embodiments, the gift card holders are directed to specific holidays or special occasions with appropriate gift cards included. Each embodiment may include electronic features, such as audio and light. The packaging of gift card and gift card holder combinations is also disclosed.

8 Claims, 12 Drawing Sheets

(56) References Cited

U.S. PATENT DOCUMENTS

| | | | | |
|---|---|---|---|---|
| 6,002,766 | A | 12/1999 | Orr et al. | |
| 7,740,170 | B2 * | 6/2010 | Singh | G09F 1/02 235/380 |
| 8,336,782 | B2 | 12/2012 | Clegg | |
| 8,672,129 | B2 * | 3/2014 | Glass | B65D 5/0005 206/461 |
| 8,839,951 | B2 * | 9/2014 | Glass | B65D 73/0007 206/232 |
| 9,016,469 | B2 * | 4/2015 | Roberts | B42D 15/042 40/124.11 |
| 9,111,275 | B2 | 8/2015 | Miller et al. | |
| 9,688,450 | B2 | 6/2017 | Hahn et al. | |
| 9,907,374 | B2 * | 3/2018 | Canaday | A45C 11/182 |
| 9,994,384 | B2 * | 6/2018 | Glass | B65D 81/365 |
| 2002/0139693 | A1 | 10/2002 | Sowers | |
| 2006/0065748 | A1 | 3/2006 | Halbur et al. | |
| 2008/0098628 | A1 * | 5/2008 | Geitner | G09F 1/06 40/124.06 |
| 2008/0245875 | A1 | 10/2008 | Holt et al. | |
| 2009/0166436 | A1 | 7/2009 | Haugen et al. | |
| 2010/0108757 | A1 | 5/2010 | Clegg et al. | |
| 2012/0031255 | A1 | 2/2012 | Stites | |
| 2012/0259718 | A1 | 10/2012 | Miller et al. | |
| 2013/0112745 | A1 | 5/2013 | Schultz et al. | |
| 2015/0314950 | A1 | 11/2015 | Lopez et al. | |

* cited by examiner

THEMED GIFT CARD AND GIFT CARD HOLDER COMBINATIONS AND PACKAGING THEREFOR

RELATED APPLICATIONS

This application is a divisional of and claims priority to U.S. patent application Ser. No. 15/698,387, filed on Sep. 7, 2017, which is a non-provisional of and claims priority to U.S. Provisional Patent Application No. 62/393,503, filed on Sep. 12, 2016. A copy of each of the aforementioned patent applications is incorporated herein by reference in its entirety.

FIELD OF THE INVENTION

This invention is in the field of social expression products, and more specifically to gift card and gift card holder bundles.

SUMMARY OF THE INVENTION

The present disclosure and related inventions are directed to various themed gift card and gift card holder combinations. In one embodiment, the gift card holders include a novelty gift item that is themed or otherwise related to the type of gift card contained therein. Other embodiments contain various three-dimensional pop-up structures and other paper engineered constructs that are shaped, decorated and otherwise themed to match an accompanying gift card. And in yet other embodiments, the gift card holders are directed to specific holidays or special occasions with appropriate gift cards included. Each embodiment may include special effects, such as audio, light and motor movement of at least a portion of the gift card holder, gift card or novelty gift item.

DESCRIPTION OF THE DRAWINGS

FIG. 5 is a perspective view of a THEMED GIFT CARD AND GIFT CARD HOLDER COMBINATION of the present invention, in an open position.

DETAILED DESCRIPTION OF PREFERRED AND ALTERNATE EMBODIMENTS

Figure 1:
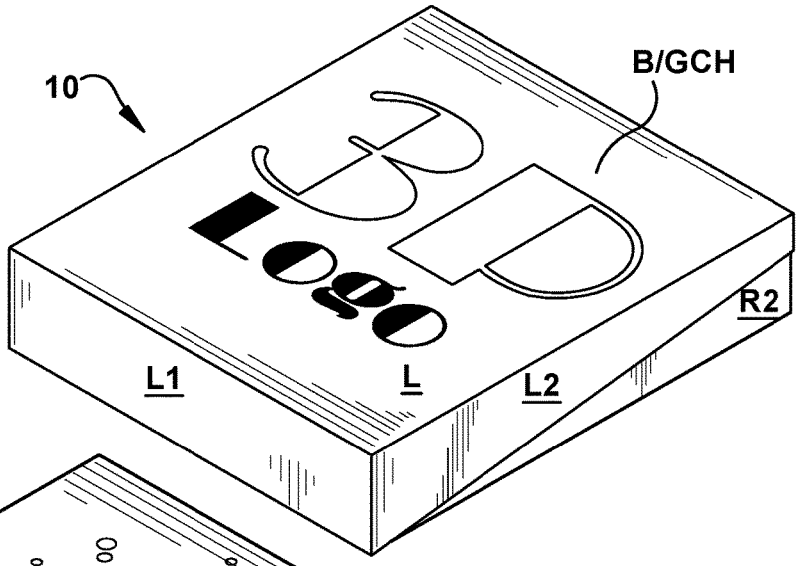
FIG. 1 is a perspective view of a THEMED GIFT CARD AND GIFT CARD HOLDER COMBINATION of the present invention, in a closed position.

The present disclosure and related inventions include various types of containers or receptacles for holding one or more gift cards therein to be presented as a gift to a recipient. The containers or receptacles are themed such that they may be suggestive of the type of gift card contained therein or of the types of items that may be purchased with the gift card. They may alternatively follow a motif based on a celebratory event or occasion. They may also be branded gift card and gift card holders that contain iconography from a specific retailer or gift card issuer. Some of the embodiments additionally contain a small gift or novelty item which also follows the theme of the packaging and gift card. Some embodiments may also include pop-up structures or other paper engineered structures which add to the delight and surprise of the themed gift card and gift card holder combinations. The combination of products, such as the gift card, gift card holder and gift item may be packaged or bundled together at retail and may also be priced as a single item.

As used herein the term "gift card holder" refers to any container, packaging, vessel, receptacle, repository which can contain one or more gift cards.

As used herein, the term "gift card" is defined as being a restricted monetary equivalent issued by retailers or banks to be used as an alternative to a non-monetary gift. Gift cards are legal tender purchased for use by a consumer and useable in its face amount in lieu of cash in exchange for goods and services supplied by the seller. Gift cards typically resemble a credit card or display a specific theme on a plastic card having a magnetic strip or bar code thereon (typically on the back surface thereof) which contains the dollar amount of the gift card. This amount is rarely stored on the card itself but instead stored in a database controlled by the seller and cross-linked to the ID stored on the magnetic strip or bar code. "Open loop" gift cards are issued by banks or credit card companies and can thus be redeemed at different establishments. Examples of open loop gift cards include, but are not limited to: Visa® and MasterCard®. "Closed loop" gift cards are issued by a specific retailer or restaurant and can only be redeemed by the issuing provider. Gift cards can be "reloadable" wherein once the dollar amount has been used, additional amounts can be added to the card such that the same gift card can be used multiple times. The term "gift card" can be used interchangeably with the term "transaction card". While not all gift cards are stored value cards (dollar amount actually stored on the card itself), stored value cards are intended to be included under the term "gift cards" as used herein.

As used herein, the term "iconography" refers to visual images, symbols, illustrations, pictorial material, artwork or modes of representation collectively associated with a particular person, group, entity or subject matter. Iconography may include logos, trademarks, service marks or other intellectual property owned by or representative of a third party.

The themed gift card holder and gift card combinations described herein may be created in partnership with specific establishments, including, but not limited to: retailers, services providers, service stations, restaurants and subscription providers (hereinafter referred to collectively as "third party" or "3P") and may thus contain themed items that are related to or include a 3P's logos, trademarks, service marks, or other associated iconography (referred to herein collectively as "3P iconography"). Gift cards which are contained within the various gift card holder embodiments disclosed herein may be branded or redeemable only at the specific 3P establishment. A gift card holder may take on the shape of 3P iconography or they may have various portions of the 3P iconography printed thereon. A small token, novelty or other gift item contained within the gift card holder may take on the shape of or otherwise relate to, resemble or advertise 3P iconography of a specific 3P establishment. In alternate embodiments, the themed gift card holder and gift card combinations may be generic and relate to a specific topic or item, such as, for example, a wedding, a girl's weekend, an exotic trip, or hobby. These generic combinations may contain branded or open loop gift cards.

In any of the embodiments disclosed herein, the gift card holder GCH may be a box B that includes a receptacle portion and a lid portion L which is attached to the receptacle portion R. The receptacle portion R contains four perimeter sides R1, R2, R3, R4 which extend upward from a bottom panel BP. A floor panel F which extends perpendicularly between the four perimeter sides R1, R2, R3, R4 of the receptacle portion R of the box B and parallel to the bottom panel BP, creates a small hidden compartment between the bottom panel BP of the box B and the floor panel F. The lid portion L of the box B is sized to fit over the receptacle portion R. The lid portion L of the box B contains three perimeter sides L1, L2, L3. Two of the perimeter sides L2, L3, which at least partially cover the two sides R2, R3 of the receptacle portion R of the box B, may be tapered from front to back, to facilitate easy opening and closing of the lid L atop the receptacle R, as shown in FIGS. 1 through 6. The lid L may be completely removable from the receptacle portion R of the box B or it may be a hinged lid L which is attached to the receptacle portion R of the box B along one perimeter edge, as shown in FIGS. 1 through 6. Both the receptacle and lid portions R, L of the box B can have printing or other indicia thereon which matches or is coordinated with the theme of the one or more gift cards GC contained therein.

In some embodiments, the box B may contain one or more inserts or structures to facilitate the holding, securement and display or presentation of a gift card GC and/or gift item G. For example, in some embodiments, a box B may include a first platform to which a gift card GC is removably attached and a second platform to which a gift item G is attached. The first platform lifts the gift card GC up into a higher and more prominent position within the receptacle portion R of the box B. In one embodiment, the first platform and attached gift card GC are located in a lowermost section of the box B. A second platform is operative to move with the opening and closing of the box B to create a more dramatic and entertaining presentation of the gift item G. The second platform moves between a first position (box lid L closed), wherein it lays substantially flat or horizontal and perpendicular to the bottom panel BP of the box B, and a second position (box lid L opened) wherein it is angled at an approximate 45-degree angle to the bottom panel BP of the box B. The second platform (and attached gift item G) is moved between the first and second positions by opening the lid L of the box B. The second platform is attached at a top edge thereof to the lid L (either directly or indirectly) of the box B such that when the lid L is opened the platform (and gift item G) moves into an angled or semi-upright position wherein an upper portion of the second platform is pushed upward and forward until it reaches an approximate 45-degree angle from the floor F of the box B. When the box lid L is closed by placing the lid L over or atop the receptacle portion R of the box B, the second platform resumes the first position.

The box B may alternately contain a first platform having an adhesive or other attachment mechanism for attaching the gift card GC thereto and a second platform with one or more cut-outs to receive a micro-gift G. The gift card GC and micro-gift G may be arranged inside the box B in a vertical arrangement or horizontally in a side-by side arrangement. Alternatively, the gift card GC may be attached, via adhesive or other attachment mechanism to the inside surface of the box lid L with the micro-gift G contained in the receptacle portion R. The gift card GC may be presented in a completely vertical or upright position or it may be angled to better read the face of the gift card GC. Alternatively, the gift card GC may be placed into a sleeve, pocket, sheath, jacket, envelope or other wrapping, or inserted into a slot or held in place by a tab or other attachment mechanism. In another embodiment, the gift card GC and/or micro-gift G may be contained on an outside surface of the box B, such as, for example the top, outside surface of the box lid L. In other embodiments, a gift card GC may be removably attached to a portion of the floor panel F or may be attached to a separate insert, panel, platform or pedestal or lid portion L of the box B. In still another embodiment, the gift card GC and micro-gift G may be contained and secured inside the box B without any additional inserts or structures. One or more micro-gifts G may also be placed in the receptacle R and/or lid L portions of the box B. The micro-gift G may be removably attached to the floor panel F or may be attached to a separate panel, platform, pedestal or to the lid portion L of the box B.

As with any of the embodiments described herein, the box B may also contain one or more pop-up elements which include one or more shapes or figures which can move between a substantially flat position (when the box is closed) to an upright position (when the box B is opened). The box B may also contain electronics therein which facilitate one or more special effects, including but not limited to: audio playback through a speaker; motorized movement of one or more mobile objects which are in, on or part of the box B (pop-up items, die cut shapes, small figures, etc.); and illumination one or more lights contained within or on the outside of the box B (referred to collectively herein as "special effects"). The electronics, in one embodiment, are contained in a hidden compartment created between the parallel bottom BP and floor F panels of the receptacle portion R of the box B. The floor panel F may have one or more openings thereon through which attachment of one or more elements contained within the box B to one or more electronic components may be possible. The electronic components may include, but are not limited to: an electronic circuit with integrated circuit chip and controller, a power source such as one or more batteries, a speaker, a memory device (may be part of integrated circuit chip) onto which at least one audio file is saved, a switch, various wires and circuitry which connect various components, and any other component which is required for or which facilitates the special effects as described above. The special effects may be initiated by a magnetic switch, a slide switch, a light sensitive switch, a motion sensitive switch, a contact switch, or any other suitable switch mechanism, when the lid is opened. The special effect may continue to be activated for a pre-determined time or it may continue until the box lid L is replaced on top of the receptacle portion R of the box B. If the special effect is active when user closes the lid L, the special effect will become deactivated and reactivated again upon subsequently opening the box B. In other embodiments, the switch may operate independently of opening or closing the box B lid L. In alternate embodiments, the box B may not contain any electronic components. Also, while the gift card holder has been described, herein as being a box B, as described above or of other construction or configuration, other containers may be used.

Themed Gift Card and Gift Card Holders with Micro-Gift

In one set of embodiments, described below, a themed gift card and gift card holder combination includes a gift card GC, gift card holder GCH and micro-gift G. Micro-gifts G may include, but are not limited to, such items as, for example: a novelty item, a token, a gag item, a memento, a keepsake, a souvenir, a collectible or a food item, a wearable item, and a household item. Examples include, but are not limited to: a jewelry item, an ornament, a small statue or figurine, a plush toy or any other giftable item. The terms "micro-gift", "gift", "gift item", "novelty item" may be used interchangeably throughout this disclosure.

Figure 4:
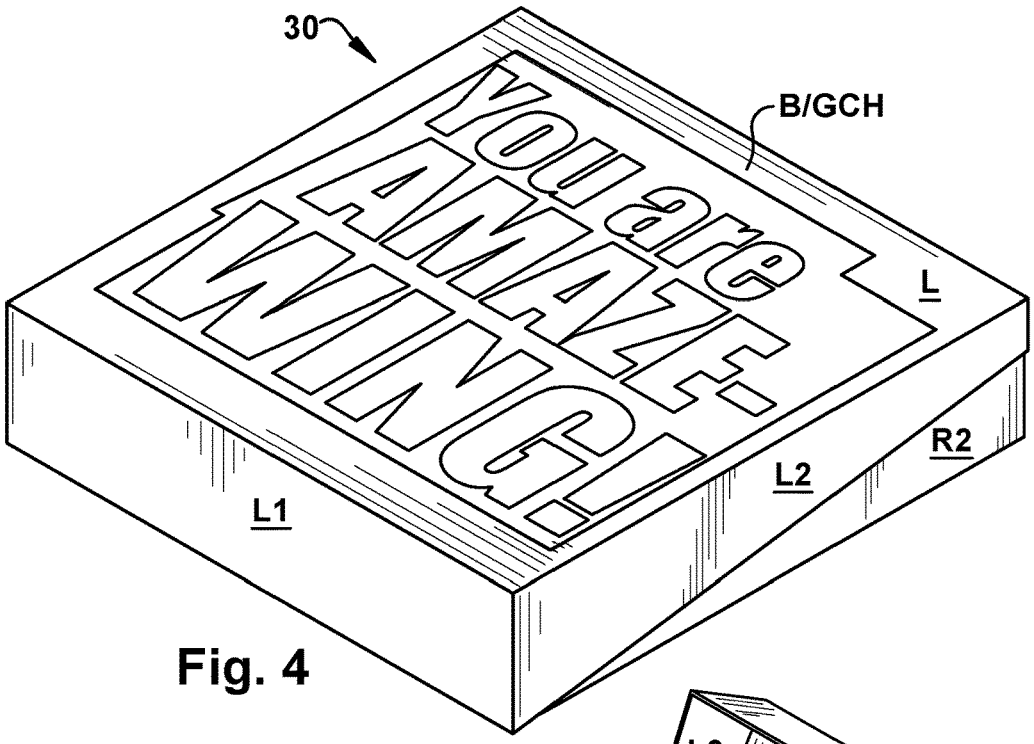
FIG. 4 is a perspective view of a THEMED GIFT CARD AND GIFT CARD HOLDER COMBINATION of the present invention, in a closed position.
Figure 5:
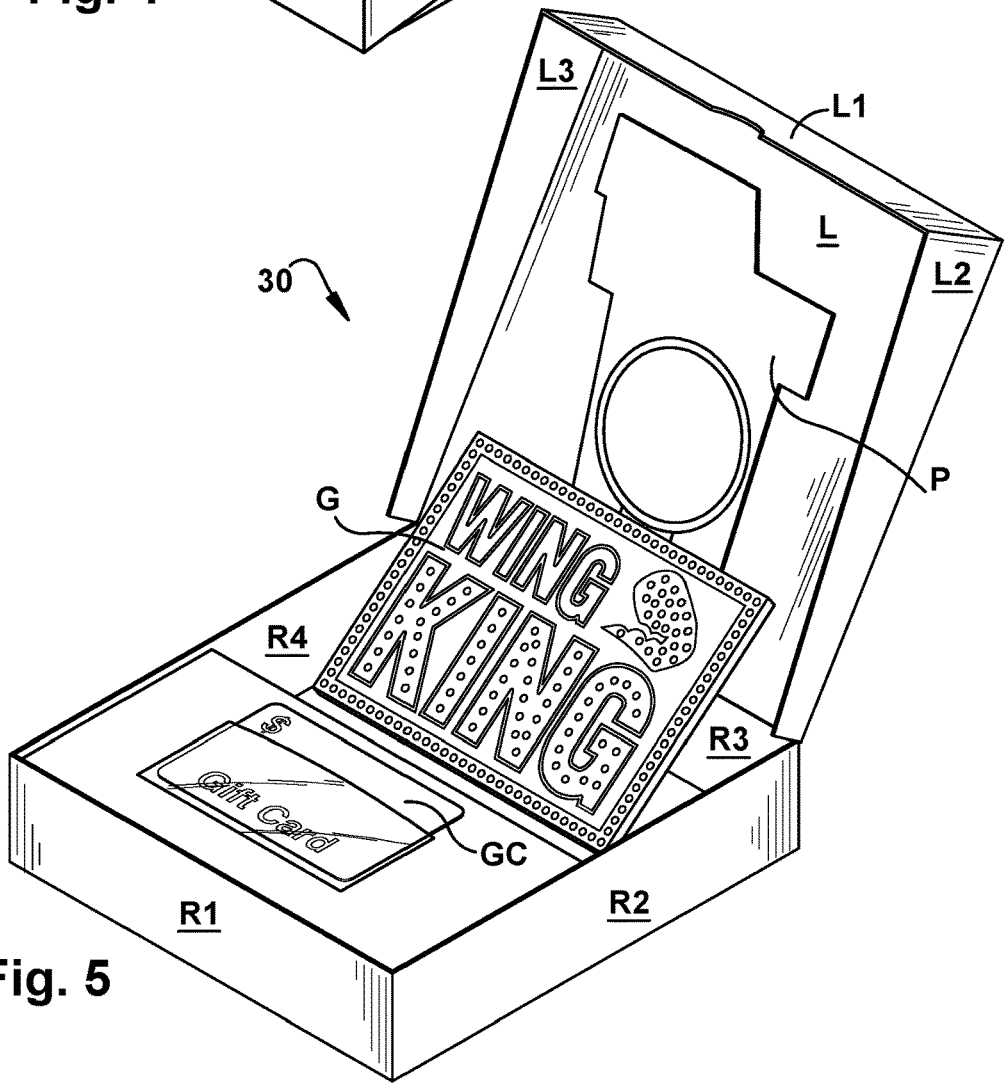
FIG. 5 is a perspective view of the THEMED GIFT CARD AND GIFT CARD HOLDER COMBINATION of FIG. 4, in an open position.
Figure 6:
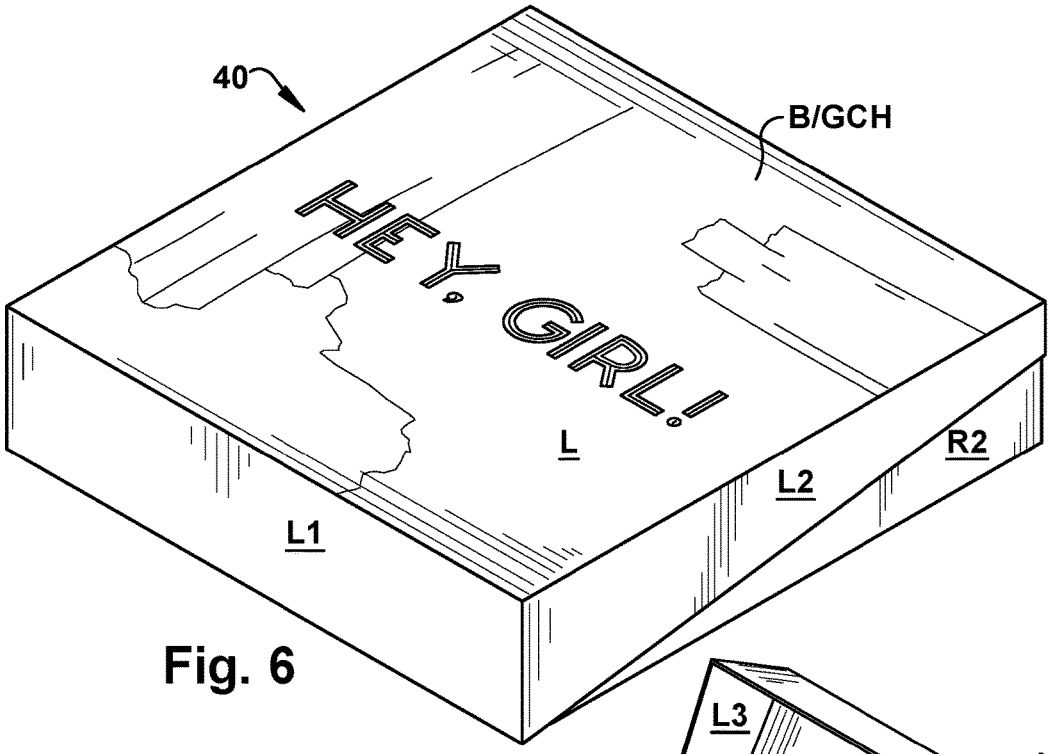
FIG. 6 is a perspective view of a THEMED GIFT CARD AND GIFT CARD HOLDER COMBINATION of the present invention, in a closed position.

In one embodiment, as shown in FIGS. 4 and 5, the theme of the box B is chicken wings. The gift card holder GCH, in one embodiment, is a box B, as described above. A gift card GC is contained on a level, platform surface (as described above) at the lowermost section of the receptacle portion R of the box B. The gift item G, which in this embodiment is a necklace with large medallion G, is contained on a platform (as described above) which moves between a first position, wherein it lays flat and perpendicular to the bottom panel BP of the box B, and a second position wherein it is angled at an approximate 45-degree angle to the bottom panel BP of the box B. The large size of the medallion G is intended to have an exaggerated or overstated effect in a funny or humorous way. The medallion G is attached to a chain that is intended to be worn around one's neck. The medallion G, in a preferred embodiment, is made of plastic, however other materials may be used. It may have words printed or molded thereon. The medallion G is intended to have a themed relationship with the gift card GC or with items that may be purchased with the gift card GC. For example, the medallion G may have the words "Wing King" molded or printed thereon and the gift card GC may be for a restaurant that serves or specializes in chicken wings. When a recipient opens the box B, the gift card GC is revealed and the novelty item or medallion G is moved between the first position, wherein it is in a flat position, somewhat beneath the platform containing the gift card GC, to the second position wherein it is positioned in an angled or leaning position so that it can better be seen by the recipient, as shown in FIG. 5. Opening the lid L may additionally activate audio, which may be related to the theme of the gift card GC and gift card holder GCH to be played through a speaker. The inside and outside surface of the box B may be printed or decorated with the theme of the gift card GC and novelty gift G. The box B may additionally contain one or more pop-up items P or other embellishment contained either in the receptacle R or inside lid portion L of the box B which follows the theme of the gift card GC and gift card holder GCH. The audio and/or other special effects, box shape, box decoration, and micro-gift may all be, in this embodiment, chicken wing-themed. The gift card holder GCH and micro-gift G may be specifically related to a specific chicken wing restaurant, such as, for example, BW3® with the gift card being BW3® branded gift card GC. The 3P iconography 11 may include, in this case, the use of trademarks, copyrights or other intellectual property associated specifically with and/or owned by BW3®, or other establishment, retailer or service provider. Alternatively, the gift card holder GCH and micro-gift G may be generically related to chicken wings with the gift card GC being redeemable at any restaurant of food establishment that may have or sell chicken wings or may be an open loop gift card GC redeemable at any accepting establishment. In other embodiments, other restaurants and food items may be used.

In a similar embodiment, a gift card and gift card holder may be themed as a popular video game and/or video game console. The gift card holder, in one embodiment, is a box, as described above. The box may be created to resemble an actual video game console or a specific video game. The micro-gift may be a necklace with medallion, similar to the necklace described above, containing a medallion with the video game makers logo or other 3P iconography. As noted above, the medallion is exaggerated in its large shape, as a funny or humorous gift item. The gift card holder and micro-gift may, in this case, use 3P iconography, such as trademarks, copyrights or other intellectual property associated specifically with and/or owned by the themed brand, such as Microsoft Xbox®, with the medallion being in the shape of an Xbox® logo, and the gift card or membership card being an Xbox® branded gift card. In other embodiments, other game companies and game consoles and games may be used. Alternatively, the box may have a generic game or gamer theme with a generic micro-gift necklace, such as a generic game console or game cartridge, etc. with the gift card being redeemable at a game store or any store that sells game consoles, games and/or gaming items or the gift card may be an open loop gift card. While the micro-gift in this embodiment has been described herein as being a necklace with medallion, the micro-gift may alternatively be a pin, a pen, a small toy or figurine, or any other novelty item.

In another embodiment, a gift card, gift card holder and micro-gift may be themed in the likeness of a movie or movie character. In one embodiment, the gift card holder is a box, as described above. The box may be decorated with printing or other embellishments which represent or are in some way related to the movie or character such as photos, drawings, movie or character quotes, and other such imagery. The micro-gift may be a keychain or keyring with attached representation of a character, such as, for example, a plastic molded likeness of a character's head, face or body. The box may also have audio capabilities, as described above, and such audio may contain a theme song or themed music from the movie, movie quotes or a message said in the voice of a character in the movie. The gift card, in this case, may be specifically branded by, for example, the movie company with ownership rights to the movie about which the gift card holder and micro-gift are themed, such as, for example, Disney®, and the box may be decorated in a Star Wars® theme with a keychain or key ring with a molded likeness of the head of Darth Vader® (or other Star Wars® character). The audio clips may contain Star Wars® themed music or Star Wars® movie clips, quotes or something recited in the voice of Darth Vader® (or other Star Wars® character). Of course, in other embodiments, other Disney® movies and characters may be used and in even other embodiments a different movie company and movies and characters owned by that movie company may be used. Alternatively, the box may have a generic movie theme with the box decorated with movie related items, and a keychain or key ring with a molded likeness of a generic movie item, such as a tub of popcorn, a movie reel, or a box of movie candy, with the gift card being redeemable at a movie theater, rental store or service, or any store that rents or sells movies or the gift card may be an open loop gift card. While the micro-gift in this embodiment is described as being a keychain or key ring, the micro-gift may alternatively be a small toy, a piece of jewelry, a trading card, or any other novelty item.

Figure 8:
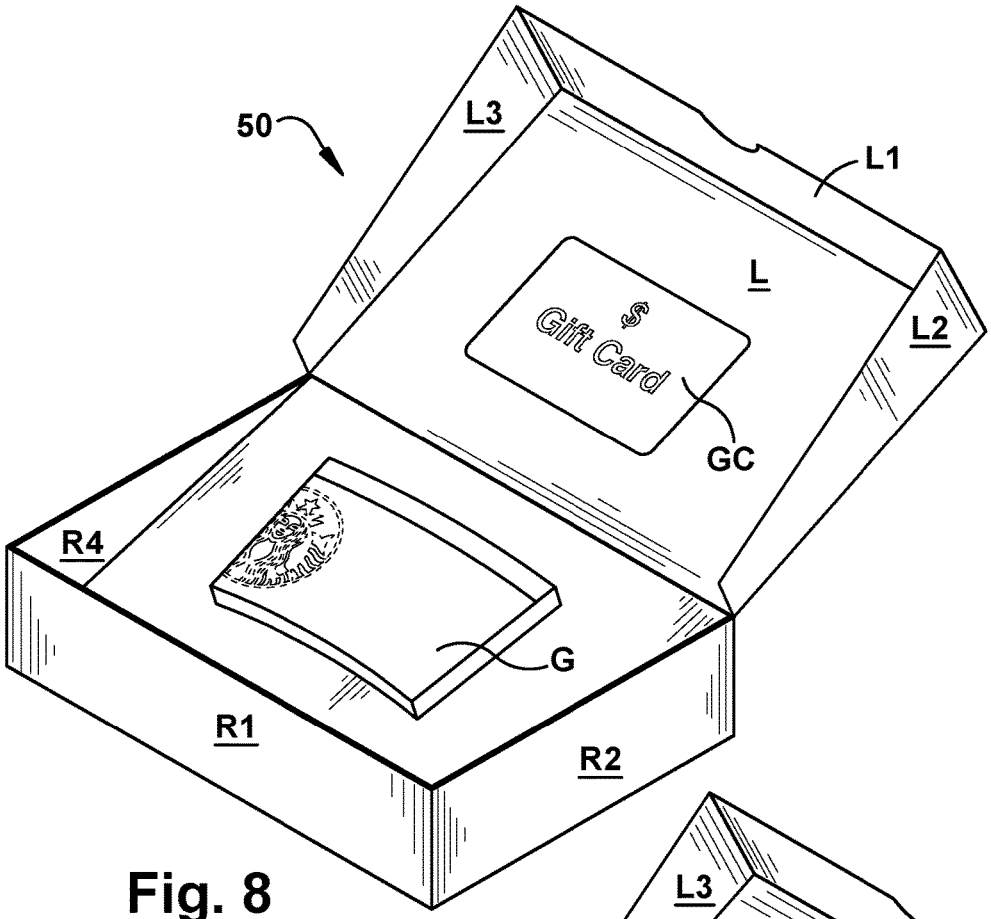
FIG. 8 is a perspective view of a THEMED GIFT CARD AND GIFT CARD HOLDER COMBINATION of the present invention, in an open position.
Figure 9:
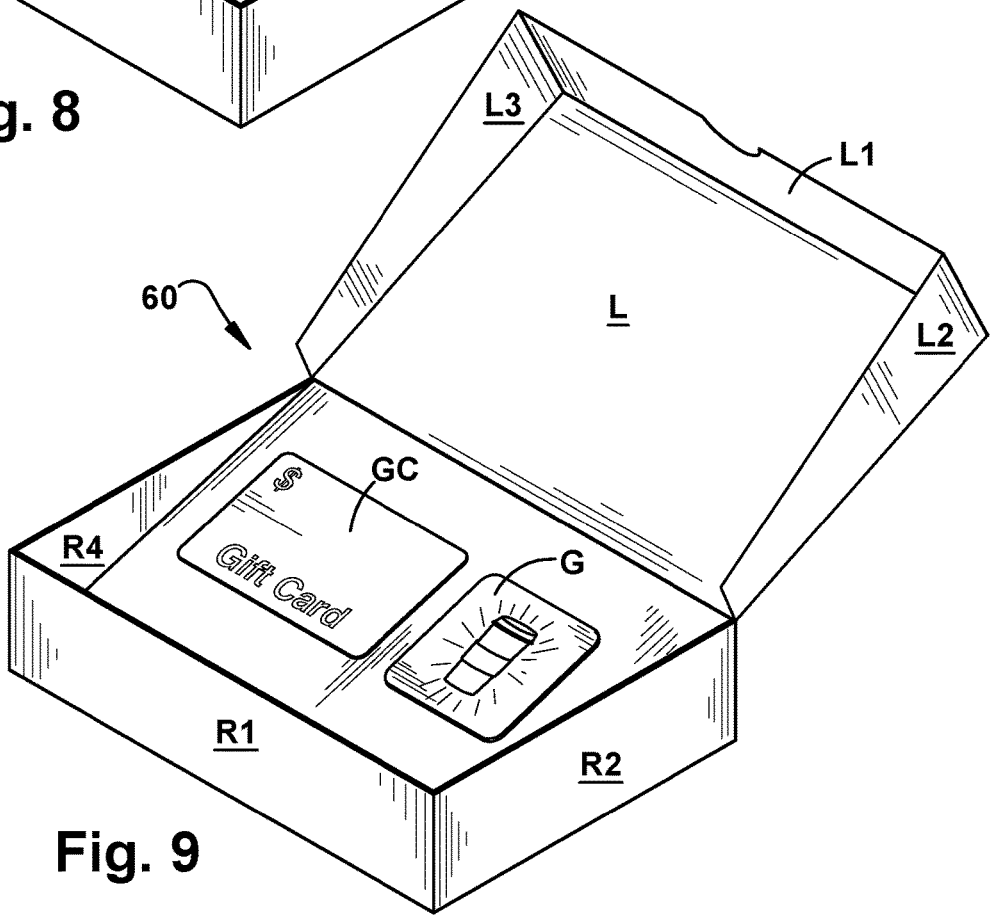
FIG. 9 is a perspective view of a THEMED GIFT CARD AND GIFT CARD HOLDER COMBINATION of the present invention, in an open position.

In another embodiment, as shown in FIGS. 8 and 9, a gift card GC, gift card holder GCH and micro-gift G are themed in the likeness of coffee or a coffee shop. In one embodiment, the gift card holder GCH is a box B. The box B may be decorated with printing and/or other embellishments which represent or are in some way related to a specific coffee shop, such as, for example, Starbucks®. The printing or embellishments may include 3P iconography 11 including trademarks, copyrights, and other intellectual property owned by Starbucks®. It may also include other generic items generally related to coffee. As shown in FIG. 9, the micro-gift G may be a pin, such as a lapel pin which is shaped like a cup of coffee, perhaps with a Starbucks® logo thereon. The micro-gift G may alternatively be a Starbucks® branded coffee sleeve G, as shown in FIG. 8. The gift card GC may be a Starbucks® gift card GC. In an alternate embodiment, the gift card holder GCH and micro-gift G may be generically related to coffee or coffee shops such as a generically shaped coffee mug or cup, a café sign, etc. The gift card GC may be redeemable at a coffee shop or grocery store or any store or restaurant that sells coffee or the gift card GC may be an open loop gift card GC.

In a similar embodiment, a gift card, gift card holder and micro-gift are themed in the likeness of a music service, such as Apple iTunes®. The gift card holder, in one embodiment, is a box, as described above. The box may be decorated printing and/or other embellishments which call to mind iTunes®, such as the use of 3P iconography owned by Apple®, such as trademarks, copyrights or other intellectual property. The micro-gift may be a pin, such as a lapel pin, with the name Apple® or iTunes® printed thereon or shaped like an Apple® logo or other such imagery. The gift card may be an iTunes® gift card GC redeemable at the Apple iTunes® store. The box may additionally contain audio or other special effects. Alternatively, the box and pin may be generically designed to evoke a musical theme, using printing and/or embellishments and shapes in the likeness of musical instruments, a radio or digital media player, a musical note, etc. and the gift card can be redeemed at a music store, a music service or the gift card may be an open loop gift card. While these embodiments have described the micro-gift as being a pin, the micro-gift may alternatively be a ring, a bracelet, a necklace, a keychain or key ring, or any other novelty gift item.

Figure 2:
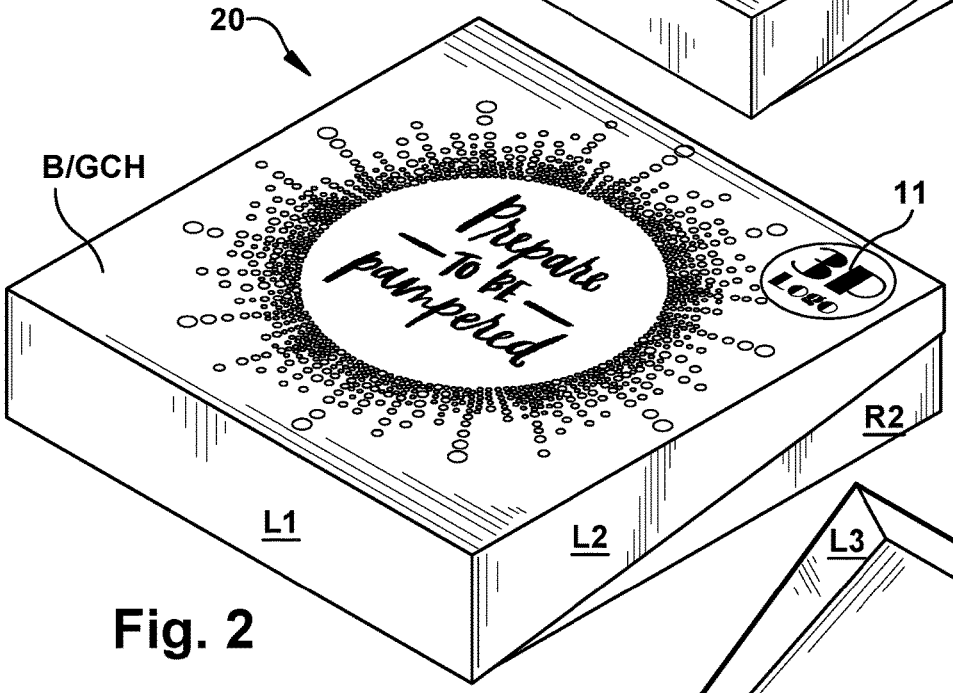
FIG. 2 is a perspective view of a THEMED GIFT CARD AND GIFT CARD HOLDER COMBINATION of the present invention, in a closed position.
Figure 3:
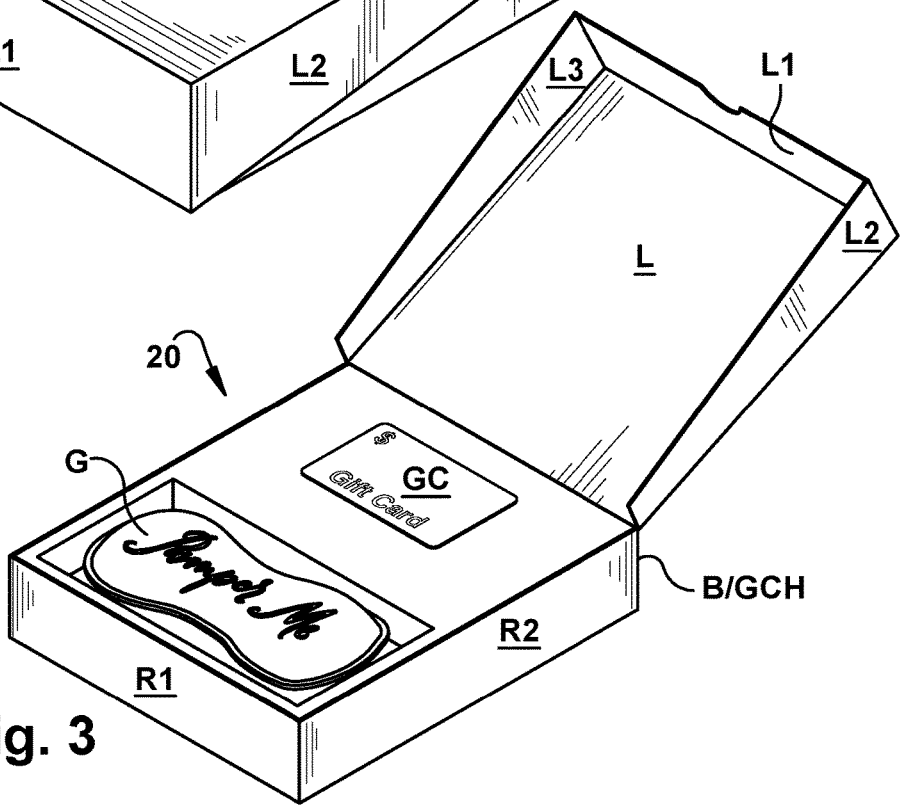
FIG. 3 is a perspective view of the THEMED GIFT CARD AND GIFT CARD HOLDER COMBINATION of FIG. 2, in an open position.

In another embodiment, shown in FIGS. 2 and 3, a gift card GC, gift card holder GCH and micro-gift G may represent a spa-themed combination. The gift card holder, in one embodiment, is a box B, as described above. The box B may be decorated and/or embellished with a spa-theme or may have words printed thereon, such as "Relax" or "Prepare to be Pampered". The micro-gift G may be, in one embodiment, a sleep mask. The gift card GC, gift card holder GCH and micro-gift G may represent a particular spa or spa service such as Spa Finder® and may contain 3P iconography 11 such as trademarks, copyrights or other intellectual property owned by Spa Finder®. The box B may also include audio which plays relaxing instrumental music or the box B may include lights or other special effects. Alternatively, the gift card holder GCH and micro-gift G may be more generically oriented with a relaxing or general spa design with a gift card GC to any spa or spa service or the gift card GC may be for a relaxing getaway at a resort or park, or the gift card GC may be an open loop gift card GC. While the micro-gift G has been described as being a sleep mask, the micro-gift G can alternately be bath salts, a CD, or other novelty item.

Figure 7:
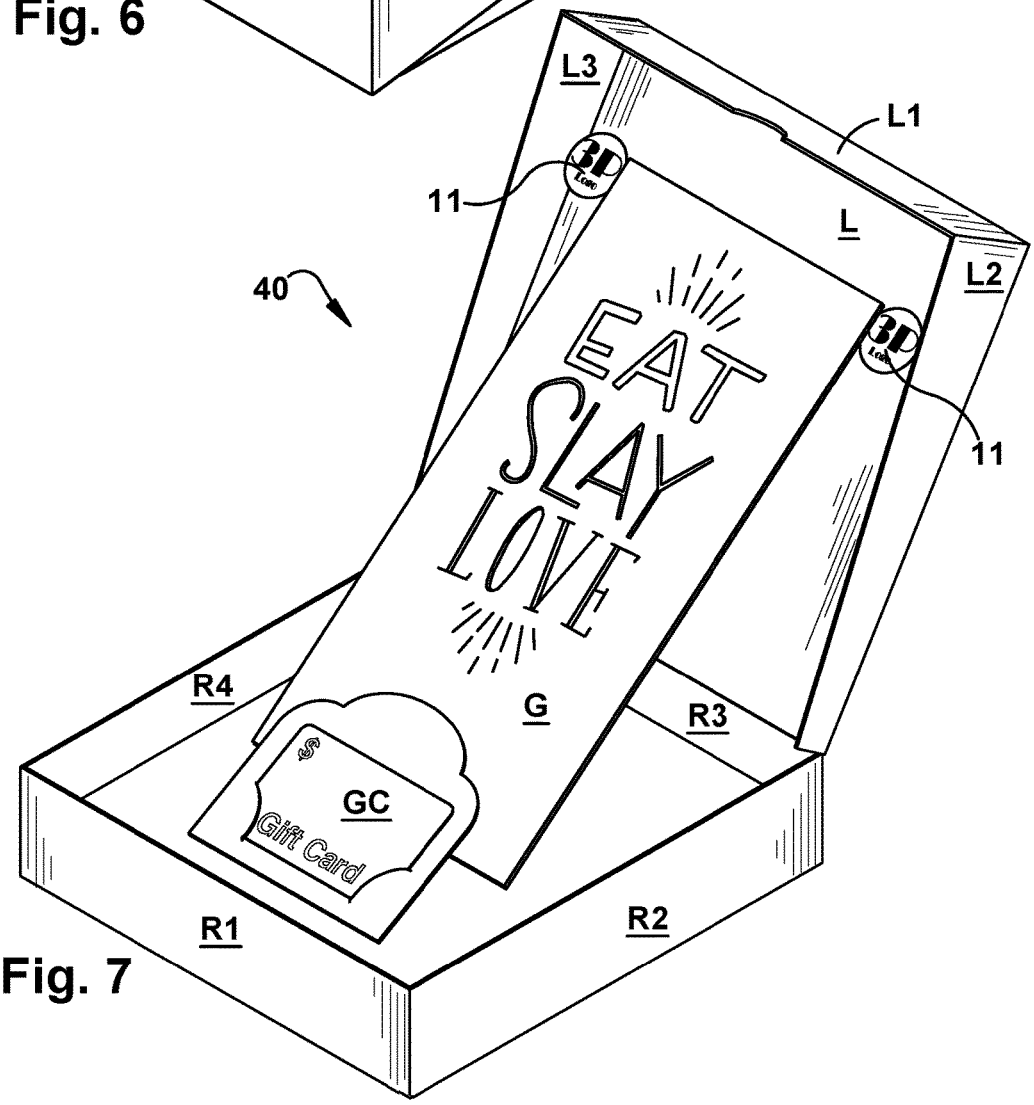
FIG. 7 is a perspective view of the THEMED GIFT CARD AND GIFT CARD HOLDER COMBINATION of FIG. 6, in an open position.

In another embodiment, a gift card, gift card holder and micro-gift may represent a broader theme that may be suitable for a larger retailer or service provider which is not focused on any one type of item or service but provides a variety of items and services. The gift card holder, in one embodiment, is a box, as described above. For example, the gift card holder and gift card combination may be designed in partnership with Walmart®. In one embodiment, the micro-gift is a talking or singing bottle opener. The gift card holder and bottle opener may contain iconic Walmart® iconography which may include trademarks, copyrights or other intellectual property owned by Walmart® with the gift card being a Walmart® branded gift card. The gift card holder and bottle opener may also utilize the iconic yellow and blue colors that are typically associated with Walmart®. In a similar embodiment, shown in FIGS. 6 and 7, the gift card holder and micro-gift may be designed in partnership with Target®. The gift card holder may be the iconic red which is used by Target® and may include the Target® bull's eye or other Target® iconography 11 which may include trademarks, copyrighted material and other intellectual property owned by Target®. In addition to being Target®-themed, the gift card holder GCH (with micro-gift G) and gift card GC combination may also have a secondary or co-theme, such as a holiday or special event theme, such as a bridal shower. The micro-gift G may be a tea towel with the gift card GC being a Target® branded gift card GC. The micro-gift G may alternatively be measuring spoons, a whisk, an apron, or any other novelty item. The wide array of merchandise sold at large retailers such as Walmart® and Target® allows for a much wider breadth of themed gift card holders GCH and micro-gifts G. Examples of other gift card holder GCH and micro-gift G themes which can be used with such large retailers include, but are not limited to: a picnic theme, a bachelorette party theme, a Christmas theme, a baby theme, or any other such theme.

In another embodiment, a themed gift card and gift card holder combination with micro-gift may contain themes including two or more 3P establishments or it may contain, as noted above, a secondary theme or have a co-theme. In one embodiment, the gift card holder is a box, as described above. For example, the box may be Netflix®-themed with the gift card holder being designed and decorated with 3P iconography, such as trademarks, copyrights and other intellectual property owned by Netflix® with a Netflix® branded gift card. In one embodiment, the micro-gift may be a replica or model of an old Atari® game cartridge with iconography of or related to the Stranger Things television series which was released on Netflix®. The Stranger Things television show is set in the 1980's which ties in to Atari® which was very popular in the 1980's. This combination is Netflix®-themed but also has a secondary or co-theme of the 1980's. The Netflix® gift card may be contained within a slot on the top surface of the replica or model Atari® game so the recipient would have to remove the replica or model Atari® game and remove the gift card therefrom. The gift card and gift card holder combination may additionally include one or more lights and audio which may be the sound of an Atari® video game or clips or quotes from the Stranger Things television show or a message delivered by one of the characters on the show. This box may be double-branded with two or more parties or entities or may have a primary and secondary theme or co-themes. This embodiment may include a primary theme of a specific 3P establishment with a secondary or co-theme of an event or occasion, a time period, a general genre such as pirate-themed or Hawaiian-themed, or any other conceivable theme.

In each of the above-described embodiments directed to a themed gift card GC and gift card holder GCH with micro-gift G combinations, the gift card holder GCH was generally described, referred to and shown in the figures as being a box B, however, other types of containers may be used. The box B has also been described and shown as being square or rectangular, however any shape may be used. While each of the above-described embodiments was described in relation to a specific micro-gift G, all of the micro-gifts G can be interchanged among the embodiments or other micro-gifts G may be added or substituted. Also, each of the embodiments may additionally include special effects such as audio, lights, motor movement of one or more mobile objects inside, attached to or part of the gift card GC, gift card holder GCH or micro-gift G.

Themed Gift Card and Gift Card Holder Combination where Gift Card Holder is a Micro-Gift In another set of embodiments, a themed gift card GC and gift card holder GCH include a micro-gift G where the micro-gift G is also the gift card holder GCH. The micro-gift G, which serves as both a novelty gift item G and a gift card holder GCH provides a relationship between the receptacle or container and the gift card GC. In this case, the gift card holder GCH is indicative or suggestive of what type of gift card GC is contained therein. As with the embodiments described above, each embodiment may be created in partnership with a third party and may contain 3P iconography, including, but not limited to trademarks, copyrights and other intellectual property owned by a branded partner.

In one embodiment, a gift card holder is in the form of a plush toy or stuffed animal (both referred to herein as "plush toy") having a pocket thereon for accommodating a gift card. The plush toy may be a sewn textile or fabric having an enclosed space within which is filled or stuffed with a filler material. The textile or fabric is typically a soft or lush material and the filler material is typically a soft material (synthetic fiber batting, cotton, etc.) making the plush toy soft and pliable similar to a cushion or pillow. The plush toy may be in the shape of a doll, an animal, a person, a cartoon character or other inanimate objects, or any other conceivable shape. The outer material may be printed with the face or face and body of the doll, animal, person, etc. upon which shape is based. The outer material may also or alternatively contain faux fur or other such material, similar to a teddy bear. The plush toy may also have audio capabilities. In a preferred embodiment, the plush toy contains a sound or audio module in the enclosed cavity therein. A trigger or actuating mechanism is provided so that a user may trigger or initiate the audio playback through the speaker. In a preferred embodiment, the trigger or actuating mechanism is a pull string or pull cord switch. A string or cord is attached to a switch at one end and at the other end to a loop or circular pull. The loop or circular pull is located on the outside of the plush toy while the string or cord is wound up in the inside cavity of the plush toy. A small opening in the perimeter of the plush toy allows the loop or circular pull to remain on the outside of the cavity and used to activate the audio. A user grips the loop or circular pull, such as between one's thumb and forefinger, and pulls outward, which unravels the string and initiates audio playback through the speaker. Once the user lets go of the loop or circular pull, the string automatically recoils back to its original position inside the cavity of the plush toy. While the portion of the string or cord that is pulled by the user is described herein and shown in the figures as being a loop or circular pull, the gripping or pull mechanism can be a tassel, a charm, ornament or any other type of pull which can be easily gripped by a user. Also, while the audio activation mechanism is described herein and shown in the figures as being a pull string or pull cord switch, other activation mechanisms can be used, including, but not limited to: a press button switch; a contact switch; a touch sensitive switch; and a motion sensitive switch. A pocket is contained on the outside surface of the plush toy to accommodate the insertion of a gift card therein. The pocket may have an open top or side wherein a portion of the gift card can be seen extending outside the pocket. The pocket would take the approximate size of the gift card to ensure a close or friction fit to retain the gift card within the pocket. The pocket may alternatively be a closed pocket having a closing mechanism, such as a zipper or a flap which must be manipulated by a user to insert or remove a gift card. The pocket may be on the front or rear surface of the plush toy. The plush toy may be in the shape of something which is related to the gift card retailer or to a product which may be purchased with said gift card. For example, the plush toy may be designed to look like a dog, a cat or other animal and the enclosed gift card may be for a pet store or a pet supply store. Alternatively, the plush toy may be shaped like a teddy bear and the enclosed gift card may be for a teddy bear building store or retailer. In another example, the plush toy may be a character from a particular video game and the gift card may be from GameStop®. The plush toy which serves as both a novelty gift or toy and a gift card holder provides a relationship between the receptacle or container and the gift card. The gift card holder may be indicative or suggestive of what type of gift card is contained therein.

In another embodiment, a micro-gift and gift card holder is in the form of a miniature barrel. The barrel may be a molded plastic (although other materials may be used) cylindrical container resembling a traditional wood barrel made of wooden staves and bound by wooden or metal hoops. The barrel may contain 3P iconography including, but not limited to: trademarks, copyrights and other intellectual property owned by the restaurant, Cracker Barrel®. Such iconography may include the Cracker Barrel® name and/or logo attached to or printed thereon. The miniature replica barrel contains a lid on top which can be removed to reveal an inner space or cavity. A branded Cracker Barrel® gift card may be contained therein. The lid may have a small handle, for removing the lid from the barrel and may also contain a sign or tag indicating that there is a gift card inside the barrel. The gift card may be contained on a backer panel or on or in a miniature greeting card. Alternatively, the gift card may not contain any other backing or packaging. The barrel may additionally contain audio capabilities which may allow audio playback through a speaker upon removing the lid from the barrel.

In another embodiment, a gift card holder and micro-gift is a small statuette or figurine in the shape of a character. The figurine may be made of molded plastic, although other materials may be used. In one embodiment, the figurine may contain a slot on an outside surface of which allows access to an inner cavity wherein a gift card may be inserted and removed. In another embodiment, the figurine may contain a channel or tabs thereon into which a gift card may be attached. In still another embodiment, the gift card may be removably attached to the figurine via adhesive or other attachment mechanism. In yet another embodiment, the figurine may be included in a small gift bag which contains both the figurine and the gift card. Once the figurine and gift card are removed from the gift bag, the gift card may be displayed upon the figurine via tabs, slots or other connection mechanism. For example, the figurine may be in the form of Mickey Mouse® (or other Disney® character) and the gift card is a Disney®-branded gift card. Mickey Mouse® is intellectual property which is owned by Disney®. This embodiment may be used in many different combinations including, for example, a digital distribution or digital media company-branded gift card within a figurine of a character or logo representing the digital distribution or digital media company or a character in one of the games, movies or other digital assets owned by the digital distribution or digital media company. For example, Google® owns the Google Android® and Google Play® brands. A logo which represents these brands is a green android robot. In a similar embodiment, a miniature replica of this android robot can be a gift card holder and micro-gift. The replica may include a plastic molded android robot with an inner cavity therein. The head of the android robot is removable from the replica robot to gain access to the inner cavity, wherein a gift card may be inserted and removed. The gift card can be a Google Play® branded gift card. The gift card may be removably attached to a backer panel or may be removably attached or connected to a miniature greeting card which is inserted into the cavity of the replica android robot. The miniature greeting card may contain a slot or pocket into which the gift card may be attached. Alternatively, the gift card may not contain any additional backing or packaging and may simply be placed inside the cavity of the replica android robot. The replica android robot may contain a sticker or a tag attached thereto which indicates to the recipient that a gift card is contained inside.

In another similar embodiment, the gift card holder may be a miniature replica of a smart phone, such as an Apple iPhone®, having a cavity therein. The miniature replica of the smart phone may contain a slot, aperture or opening along a top side thereof into which a gift card may be inserted and removed. The gift card may be an Apple iTunes® branded gift card. As with the previous examples, the gift card may be attached to a backer panel or to a miniature greeting card. Alternatively, the gift card may contain no further wrapping or packaging. The opening within the replica smart phone is not large enough to fit the entire gift card, such that a portion of the gift card (with or without additional packaging), remains outside of the replica so that the recipient can see that a gift card is contained therein.

Figure 10:
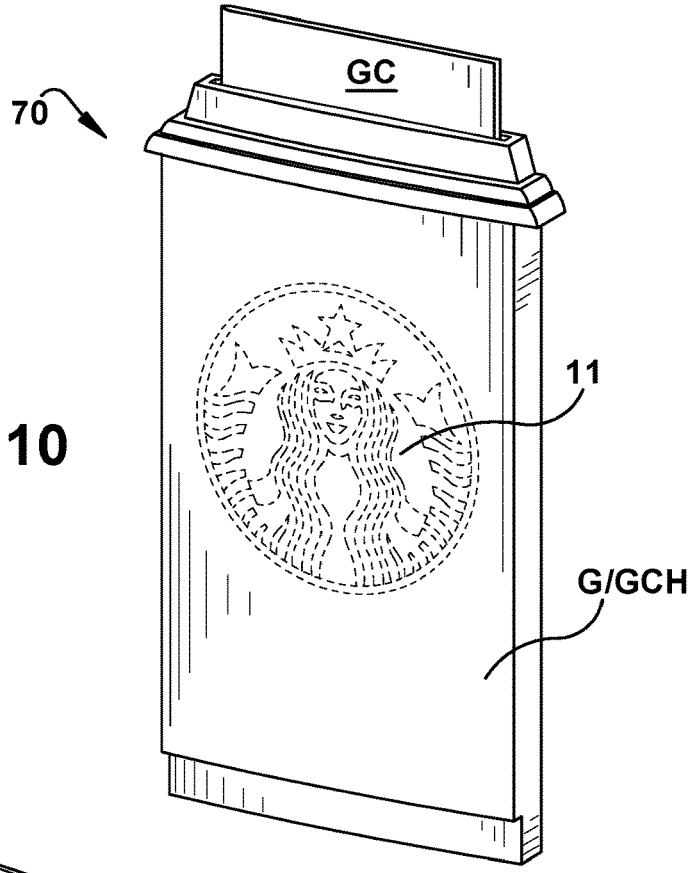
FIG. 10 is a perspective view of a THEMED GIFT CARD AND GIFT CARD HOLDER COMBINATION of the present invention, with gift card inserted therein.
Figure 11:
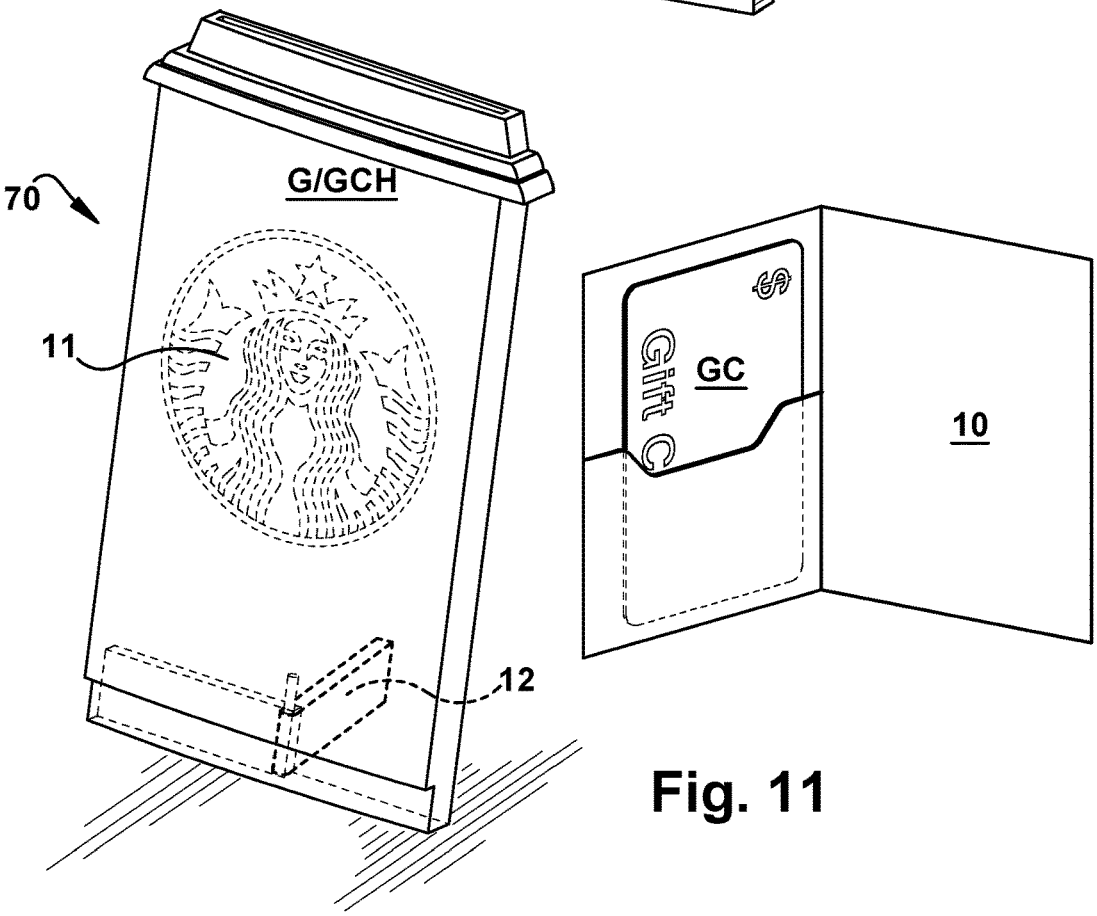
FIG. 11 is a perspective view of the THEMED GIFT CARD AND GIFT CARD HOLDER COMBINATION of FIG. 10, with gift card removed therefrom.

In another similar embodiment, shown in FIGS. 10 and 11, a gift card holder GCH may be a miniature replica of a Starbucks® coffee cup with Starbucks® gift card contained therein. The replica may contain 3P iconography 11 representative of Starbucks®, such as the shape of the cup, a Starbucks® logo or other trade or service marks. As with the previously described example, the replica coffee cup G/GCH contains a cavity therein with a slot, aperture or opening along a top side thereon into which a gift card GC may be inserted and removed. The slot, aperture or opening is not large enough to fit the entire gift card GC therein so a portion of the gift card GC remains outside of the cavity so the recipient can see that a gift card GC is included. The miniature replica coffee cup G/GCH may additionally contain a moveable arm or stand 12 which can initially be integrated within the miniature replica coffee cup G/GCH and which can move outward into a perpendicular position with respect to the replica G/GCH to serve as a kick-stand which can be used to maintain the replica G/GCH in a standing or upright position such that the recipient may display said replica G/GCH on a flat surface, such as a desk or a table.

Figure 12:
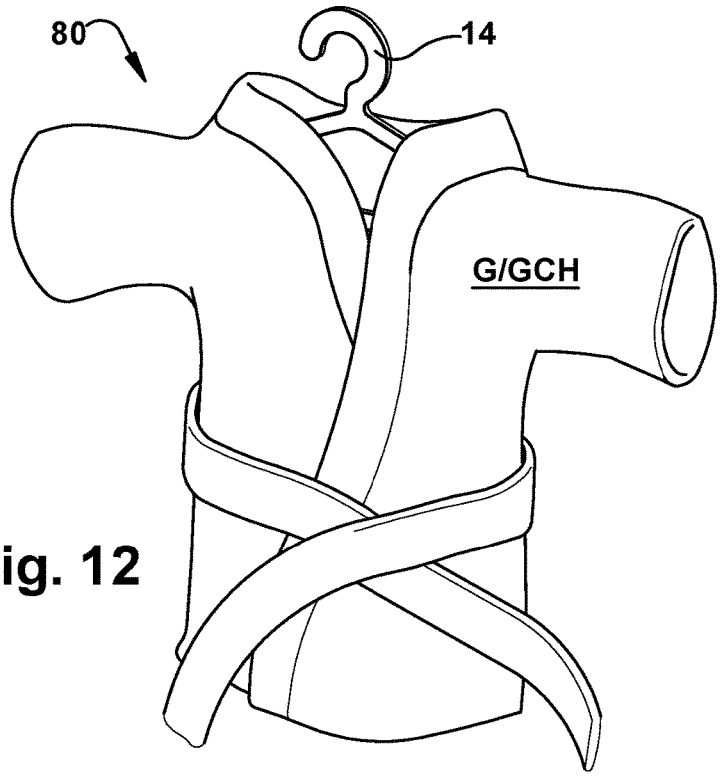
FIG. 12 is a perspective view of a THEMED GIFT CARD AND GIFT CARD HOLDER COMBINATION of the present invention, in a closed position.
Figure 13:
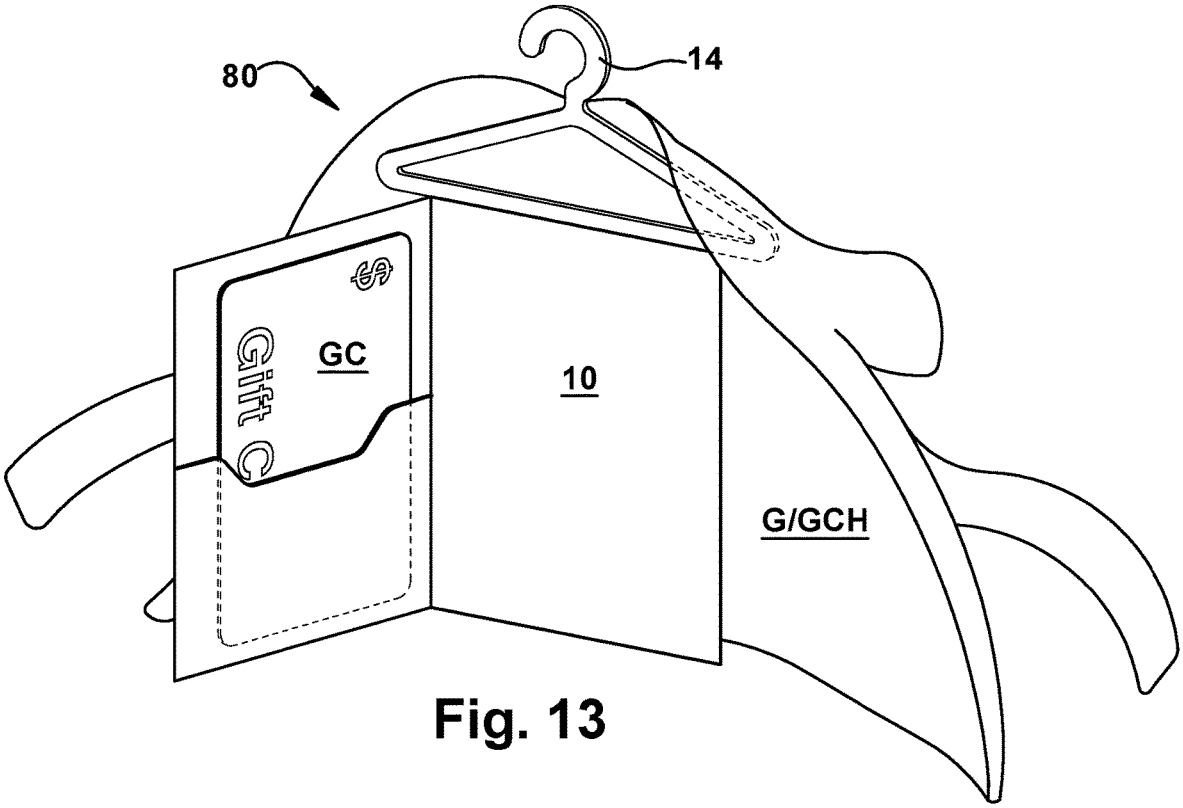
FIG. 13 is a perspective view of the THEMED GIFT CARD AND GIFT CARD HOLDER COMBINATION of FIG. 12, in an open position.

In still another embodiment, shown in FIGS. 12 and 13, a gift card holder GCH includes a miniature clothes hanger with miniature spa robe hanging therefrom or attached thereto. A Spa Week® branded gift card GC is attached thereto. The gift card GC may be removably attached to a backer panel or inserted or connected to a miniature greeting card 10 or the gift card GC may not contain any further attachment or packaging. The backer panel or gift card 10 is attached to the miniature hanger 14. The miniature spa robe G/GCH is draped over the hanger 14 and closed around the hanger 14 by a miniature belt. When the miniature robe G/GCH is in a closed position around the hanger 14 by tying the miniature belt around the miniature robe G/GCH, the gift card GC is not visible. When the recipient unties the miniature belt from the miniature robe G/GCH, the gift card GC is revealed. The miniature robe G/GCH may also have a tag attached thereto notifying the recipient that a gift card GC is contained therein. In one embodiment, the combined gift card holder/micro-gift G/GCH is not a branded item but a generic item symbolizing a trip to a spa.

Themed Gift Card and Gift Card Holders with Pop-Up Structure

In another set of embodiments, a gift card holder is a box having audio and light capabilities and an intricate three-dimensional (3D) pop up structure.

In one embodiment, a gift card holder contains a wedding theme with a Target® branded gift card therein. As mentioned above, with respect to a previous embodiment, some themed gift card and gift card holder combinations can have a primary and secondary theme or two equally relevant themes. For example, a box may be Target® (or other 3P) branded and may include 3P iconography including, but not limited to trademarks, copyrights and other intellectual property owned by Target®. The box is also wedding-themed, as many consumers purchase wedding gifts from Target® and many newlyweds shop at Target for basic household goods, electronics, furniture, etc. The box may additionally be branded a "luxe" or "elegant" box having premium materials and embellishments. An intricate 3D structure, which may take the shape of a tiered wedding cake, may be contained on the underside of the lid portion of the box, to be revealed to the user when the lid is lifted off the top of the box. When the lid is lifted, a switch may cause illumination of a plurality of lights attached to the 3D structure. The 3D structure may have several layers or tiers, taking the shape of a wedding cake. The 3D cake structure may have a flat back-piece (attached to the underside of the lid) with elaborately decorated foam layers each representing a cake tier. Various paper engineered ornaments and decorations may be attached to each foam layer to resemble decorative cake icing. A 3D ornament or paper structure may be placed on top of the foam layers to represent a cake topper. An envelope tied with a ribbon may be contained at the center of the receptacle portion of the box. When the ribbon is untied, four portions of the envelope may be folded outward to reveal an inner greeting panel or miniature greeting card. The greeting panel may have printed sentiment such as "On the Happiest of Days" along with printed decorations, etc. Lifting the greeting panel may reveal a gift card therebeneath. Audio playback may also occur upon opening the box. The box is related by theme to the gift card. For example, the gift card may be decorated with a wedding or love theme and the gift card may be from a retailer on the recipients wedding registry. As another example, the box may be branded as a "luxe" box having upgraded materials and embellishments and the gift card contained therein may be for larger amount of money such as $100, $200 $500 and up.

Figure 14:
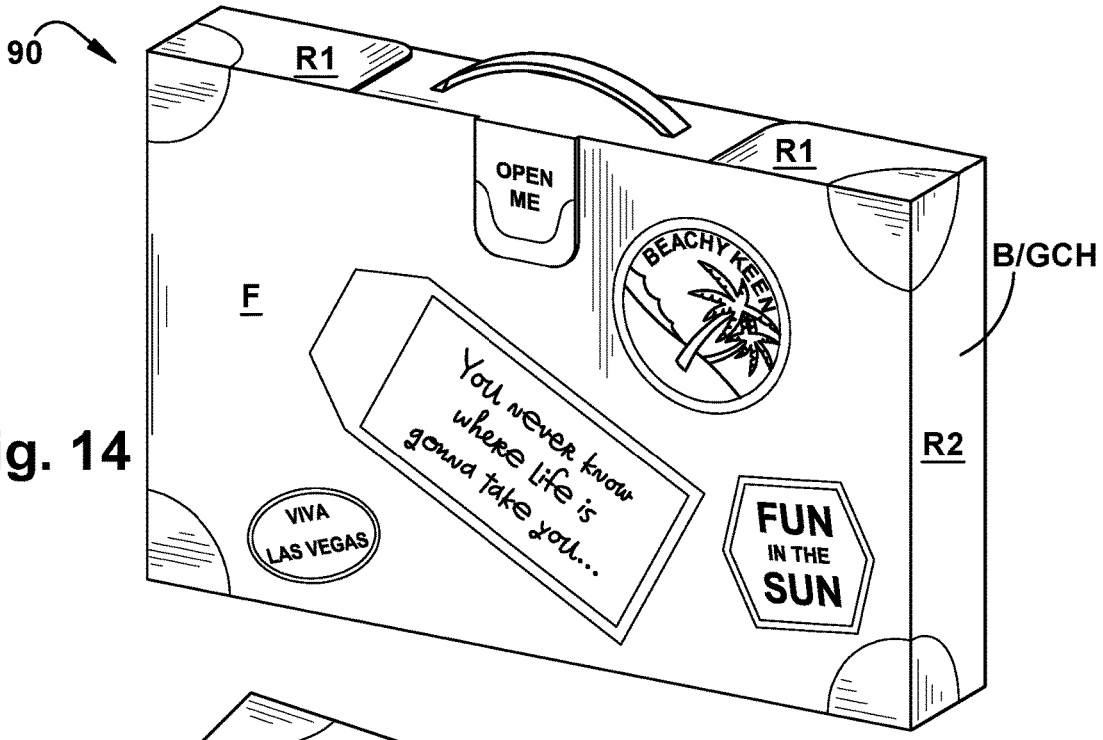
FIG. 14 is a perspective view of a THEMED GIFT CARD AND GIFT CARD HOLDER COMBINATION of the present invention, in a closed position.
Figure 15:
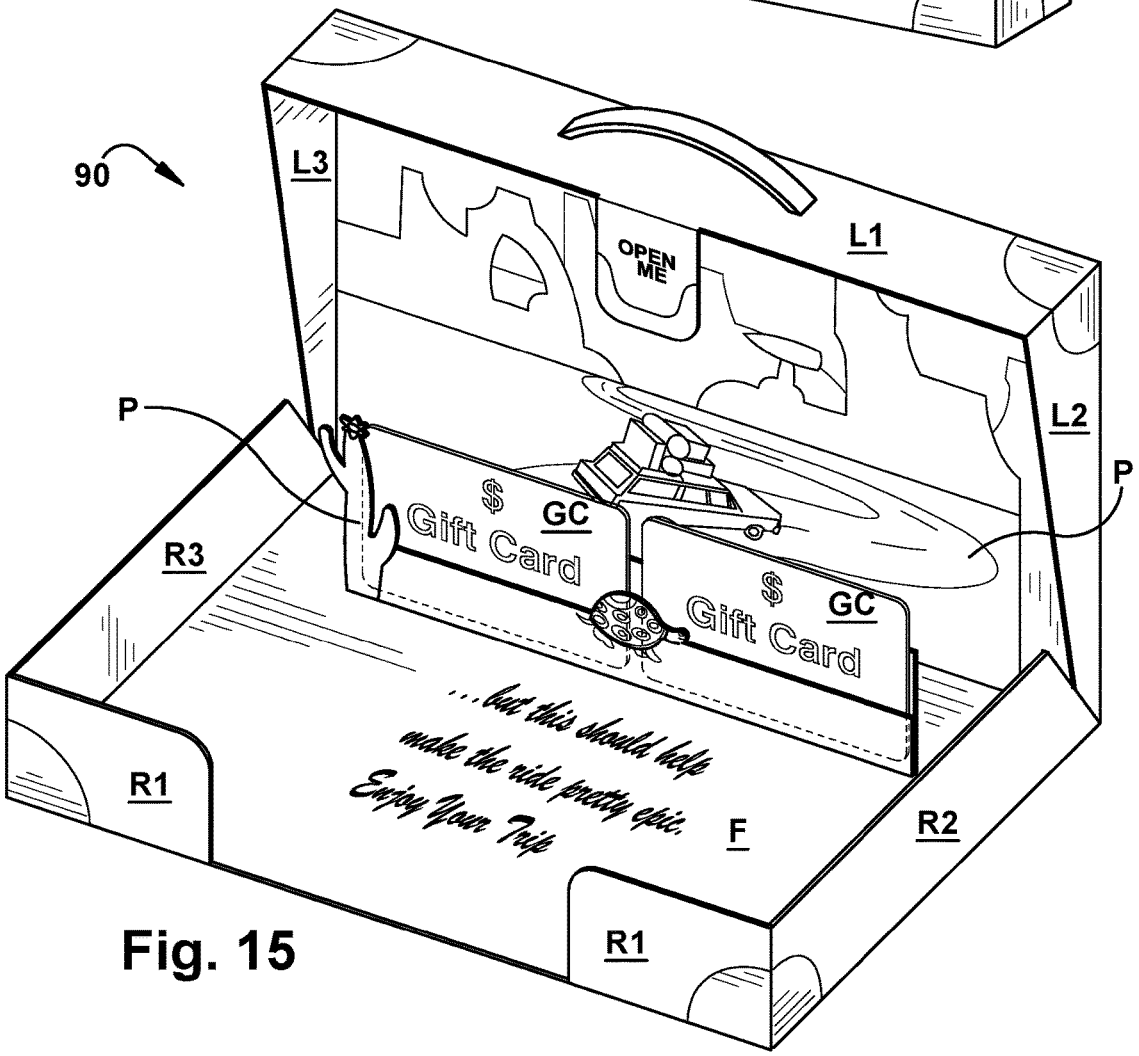
FIG. 15 is a perspective view of a THEMED GIFT CARD AND GIFT CARD HOLDER COMBINATION of FIG. 14, in an open position.
Figure 17:
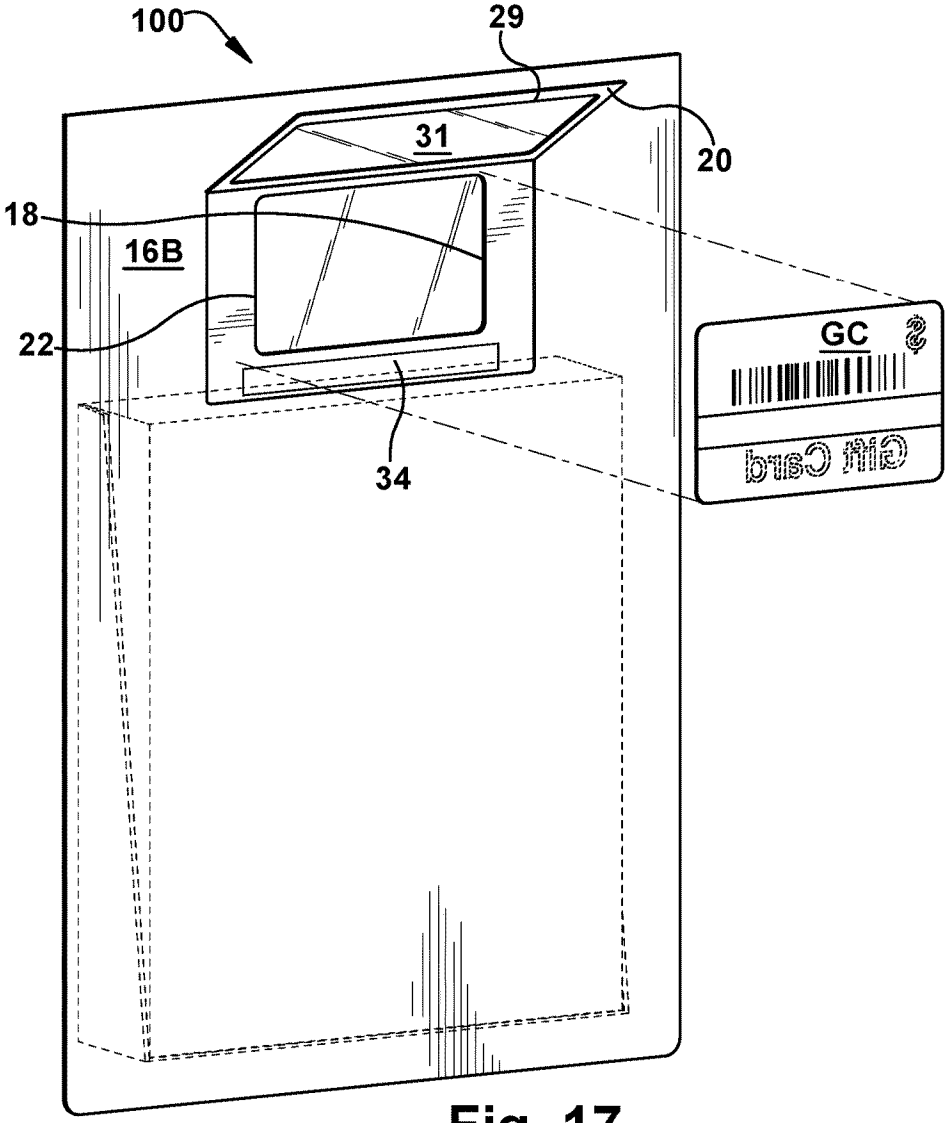
FIG. 17 is a rear perspective view of the packaging for a THEMED GIFT CARD AND GIFT CARD HOLDER COMBINATION of FIG. 16, prior to gift card insertion.
Figure 16:
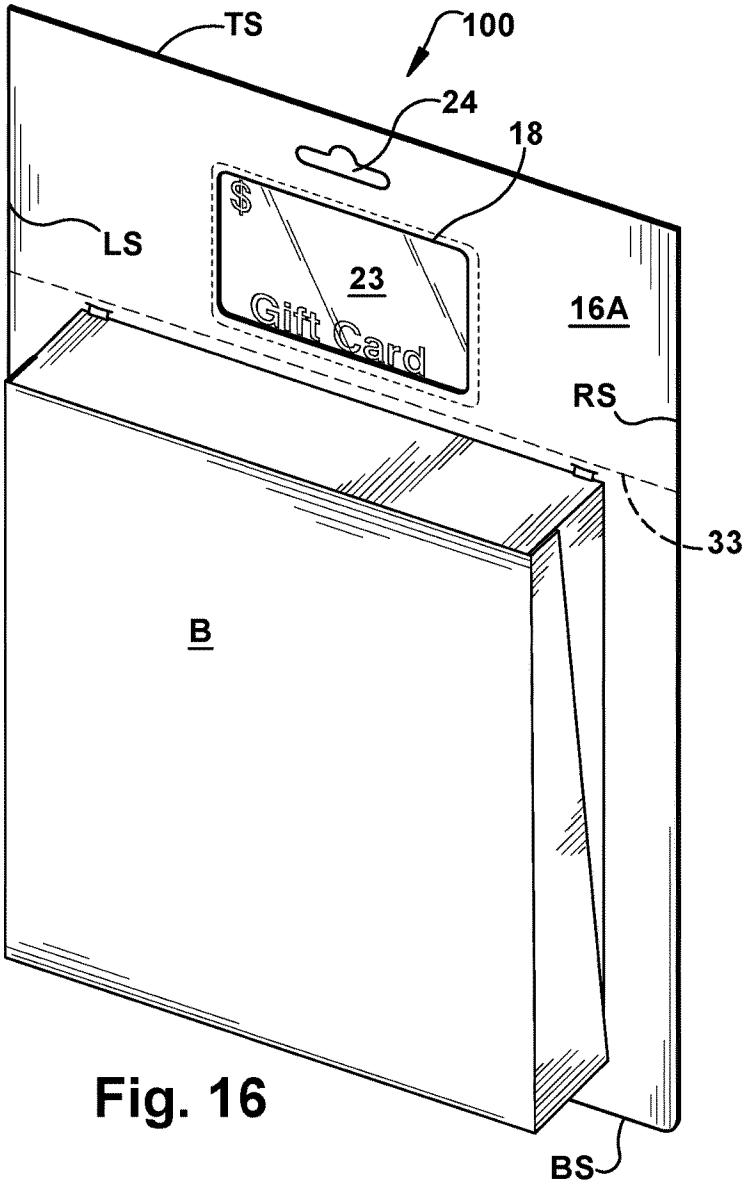
FIG. 16 is a front perspective view of a first embodiment of the packaging for a THEMED GIFT CARD AND GIFT CARD HOLDER COMBINATION, with gift card holder in a closed position.
Figure 19:
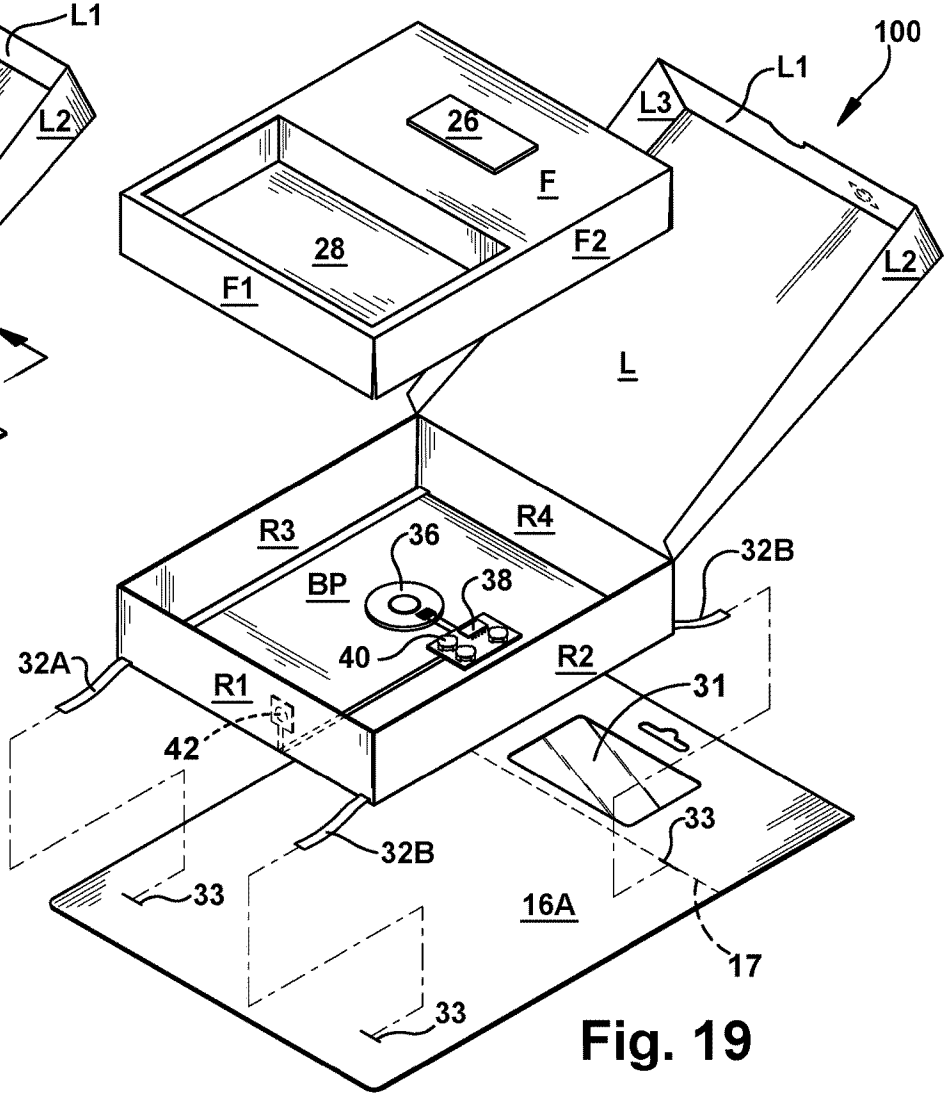
FIG. 19 is an exploded view of the packaging for a THEMED GIFT CARD AND GIFT CARD HOLDER COMBINATION of FIG. 16.
Figure 18:
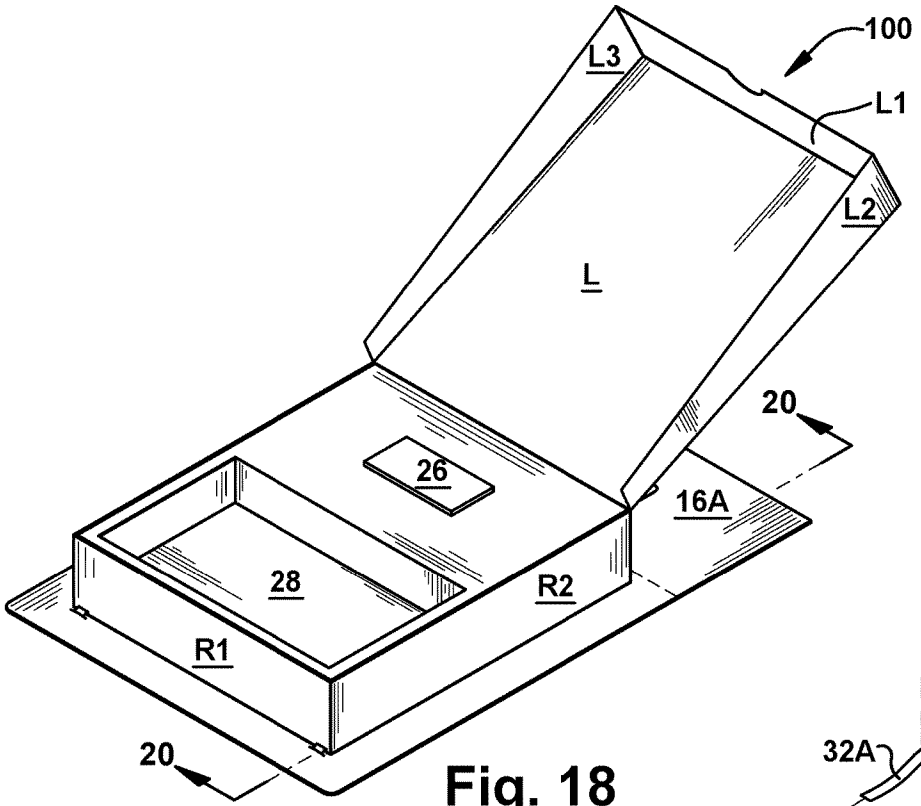
FIG. 18 is a perspective view of the packaging for a THEMED GIFT CARD AND GIFT CARD HOLDER COMBINATION of FIG. 16, with the gift card holder in an open position.

In another embodiment, a gift card holder GCH, as shown in FIGS. 14 and 15, is a themed box B having at least two gift cards GC and audio capabilities. This gift card GC and gift card holder GCH combination may be branded a "Road Trip" box because it contains two different gift cards GC which would be useful to someone taking a car or road trip. For example, one gift card GC may be a Shell® branded gift card GC and also an open loop gift card GC, such as a MasterCard® or Visa® branded gift card GC. Alternatively, the gift cards GC may be a specific hotel-branded gift card GC or trip or travel-related gift card GC. The box B may contain a hinged lid L which is attached to one side of the box B and is non-detachable from a receptacle portion R of the box B. When the lid L is opened, two or more gift cards GC (or gift card sleeves with gift cards GC contained therein) are revealed and the audio playback is initiated. The box B may be shaped and decorated to resemble a suit case with various print items thereon and a suitcase or luggage handle attached to the lid portion L of the box B. The box B may also contain a faux ID tag attached to the handle or to the box B. The box lid L may contain one or more popup structures or three-dimensional structures P attached to the inside of the lid L that resemble a landscape, such as a desert road, a beach or a cityscape. The three-dimensional structure P may contain a die cut shape attached thereto via a spring mechanism. The die cut shape may bounce or bobble on the spring when the box B is moved or when the lid L is lifted from the box B. The three-dimensional structure P may have a tab that is attached to thin receptacle or holder which is operative to accommodate at least one gift card GC inserted therein. In a preferred embodiment, two gift cards GC are contained within the thin sleeve, receptacle or holder in a side-by-side arrangement. The sleeve may extend across the width of the box. When the lid L is in a closed position, the sleeve is laid flat in a face down position (facing the floor F or bottom panel BP of the box B). When the lid L is lifted from the top of the box B, the tab pulls the sleeve up to a standing or erect position with the gift cards GC contained in the sleeve positioned in a front facing manner, as shown in FIG. 15. The sleeve may simply have a backing approximately the height of a standard gift card GC with a width that extends across the width of the box B. It may additionally contain a side and bottom frame which facilitates insertion and storage of the gift cards GC therein while allowing an almost full front facing view of the gift cards GC. The box B is related by theme to the gift cards GC contained within the box B. In this embodiment, two gift cards GC are included which are from two different 3P establishments. The gift cards GC are related to the "road trip" theme by being, for example, a gas station gift card GC and a general-purpose gift card GC. The box B ties into the "road trip" theme by being shaped like a suitcase with travel-related icons or images printed thereon and by having the intricate pop-up structures that related to the "road trip" theme and add to the overall gift presentation aspect of gifting a gift card GC.

In another embodiment, a gift card holder GCH takes the shape of a duct tape-wrapped box on a wooden pallet and the gift card GC is a Home Depot® branded gift card GC. In order for the recipient to remove the gift card GC from the gift box, he or she must first remove all the layers of duct tape. A tag may be attached to the outside of the box with directions for the purchaser and/or recipient. The box is intended as a funny or humorous take on the use of duct tape to perform many different tasks. The box may contain a sign on the top thereof which indicates "Rip Me Open" to indicate to the recipient that he or she should remove the duct tape to reveal the contents of the box. The box may contain several layers of duct tape, making it difficult for the recipient to open the box, thereby adding to the funny or humorous element. The box itself includes a receptacle portion R and a lid portion L. The lid L may be permanently attached, along one side to the receptacle portion R of the box or it may be completely removable. The box is attached, at the bottom surface thereof to a small wooden pallet to further the industrial or home improvement theme of gift card holder/gift card combination. Once the recipient has opened the box, a gift card GC is revealed among a plurality of bright orange paper strips or confetti. As noted above, in keeping with the theme of the gift card holder, the gift card may be from The Home Depot® or other hardware or home improvement store.

Themed Gift Card and Gift Card Holder Combinations with Slide-Apart Reveal

In another set of embodiments, a gift card holder is a container having two separate, opposing sides and a hidden panel contained therebetween onto which a gift card is removably attached. The outside of the pull-apart structure may be decorated with printing and/or other embellishments that are related to or which indicate the type of gift card is contained therein. The pull-apart structure may be made of paperboard, cardboard, plastic, or any other suitable material. The gift card holder can be formed into any shape or profile, examples of which include, but are not limited to: a circle, a cupcake, a candle, an animal, a person, a baby carriage, a Christmas tree, a pumpkin, or any other conceivable shape. The outer surfaces of the gift card holder can be printed with photos, pictures, drawings or any other type of printed material. The gift card holder may be designed with a particular partner and may contain 3P iconography, such as trademarks, copyrights, and other intellectual property owned by the 3P establishment. The gift card holder includes a right portion and a left portion which are connected to one another via a hidden inside panel. The right and left side portions of the gift card holder each have three closed perimeter sides and one open perimeter side forming an open sided cavity therein. The open sides of each portion face each other or the left side portion contains the open perimeter side on the right and the right side portion contains the open perimeter side on the left. The front and back surfaces of the right and left portions of the gift card holder and the inside hidden panel are generally planar and can contain printing thereon. The printing on the right and left portions of the gift card holder may together form a single picture or scene with half of the picture or scene printed on the left portion and the other half printed on the right portion such that when the two panels are adjacent to each other (with the open sides in contact with one another) the picture or scene is completed. The front surface of the right and left portions may bear decoration consistent with a front view and the opposing rear surface may bear decoration consistent with a rear view thereof. The hidden inner panel of the gift card holder fits within the bifurcated pocket created by the left and right side portions of the gift card holder. When the left and right side portions are pushed together such that the right side of the left panel and the left side of the right panel are in directed contact, the hidden inner panel is completely hidden within the gift card holder. The hidden inner panel, in a preferred embodiment is a rectangular-shaped panel having two tabs or stoppers contained at each distal end. The two tab or stoppers prevent the hidden inner panel from being completely removed from the pockets in the right and left side portions of the gift card holder. A gift card is removably attached at the approximate center of the hidden inner panel. In operation, the gift card holder is originally in a closed position wherein the hidden inner panel is hidden or completely contained within the right and left side pockets of the gift card holder and the scene or picture printed on the right and left side pockets is complete (each side contains a portion of the scene or picture). A user may open the gift card holder by grasping each side, such as between one's thumb and forefinger and pulling in opposite directions. Opening the gift card holder reveals the hidden inner panel with gift card attached thereto. The tabs or stoppers located at each distal end of the hidden inner panel catch on a closed perimeter portion of the right and left sides such that the panels can only be moved apart a distance approximately equal to the width of the hidden inner panel and the hidden inner panel cannot be removed from the right and left pockets of the gift card holder. The scene or picture printed on the right and left sides of the gift card holder are related by theme to the gift card or to items which may be purchased by the gift card. For example, the outer surfaces of the right and left side pockets can be printed with a picture of a sub sandwich and the gift card may be for the Subway® sandwich shop. As another example, the gift card holder may be shaped like an Xbox® game controller with an Xbox® branded gift card inside.

Gift Card and Gift Card Holder Bundled Packaging

The various themed gift card GC and gift card holder GCH bundles described herein, can be packaged, priced and sold as a single item at retail. This configuration makes shopping for a gift card GC and gift card holder GCH easy and quick but also provides the consumer with an engaging and interesting way to present a gift card to a recipient. It also allows Bundled Package with Box as Gift Card Holder In one embodiment, the gift card holder GCH is a box B, as described herein. This packaged bundle provides access to the box B and its contents such that consumer can open and experience the box B before deciding to purchase.

The structure 100 includes a backer panel 16, a box B, and one or more straps 32, for holding or securing the box B to the backer panel 16. The backer panel 16 contains a first sheet 16A and a second sheet 16B which, in one embodiment, are substantially equal in size, substantially rectangular in shape and having four perimeter sides including a top side TS, a bottom side BS opposite the top side TS, a right side RS, and a left side LS opposite the right side RS. The first and second sheets 16A, 16B are attached at least along a top side TS thereof. The first sheet 16A of the backer panel 16, which serves as the front of the gift card packaging 100, contains, in one embodiment, a rectangular aperture or window 18 thereon. The aperture or window 18 is generally the same size as a traditional gift card having an approximate 3⅜-inch width and an approximate 2⅛-inch height. The aperture or window 18, in one embodiment is horizontally centered in an upper region of the first sheet 16A of the backer panel 16, proximate to the top side TS. The window 18 may additionally contain a clear plastic, acetate or vacuum formed panel or sheet 23 beneath which the gift card GC is inserted. The second sheet 16B of the backer panel 16, which serves as the back or rear of the gift card packaging 100, contains an aperture or window 22 thereon, which is aligned directly with the aperture or window 18 on the first sheet 16A of the backer panel 16. The second sheet 16B of the backer panel 16 also contains a flap 20 thereon. The flap 20 is oriented such that it is directly over the aperture or windows 18, 22 contained on the first and second sheets 16A, 16B of the backer panel 16. The flap 20 contains four sides, at least one of which (preferably the top side), is attached to or integral with the second sheet 16B of the backer panel 16. The flap 20 contains an aperture or window 29 in the shape of a rectangle which is horizontally centered thereon and aligned directly with the aperture or windows 18, 22 on the first and second sheets 16A, 16B of the backer panel 16. The flap 20 may additionally contain a transparent plastic or acetate sheet material 31 which covers the aperture or window 29 thereon and through which the gift card GC is visible. When a gift card GC is positioned within the space between the first and second sheets 16A, 16B of the backer panel 16, the front face of the gift card GC is visible through the aperture or window 18 on the first sheet 16A (and transparent material 23) and the rear face the gift card GC is visible through the aperture or window 22 on the second sheet 16B of the backer panel 16 and the flap 20 (and transparent material 31). The first and second sheets 16A, 16B of the backer panel 16 may additionally contain an aperture or opening 24 in a top portion thereof which facilitates the suspension of the entire packaging 100 from a rod or hanger.

The box B, in one embodiment, is attached to the backer panel 16 by one or more bands or straps 32. The one or more bands or straps 32 secure the box B to a front surface (first sheet) 16A of the backer panel 16, preferably below the aperture or window 18 located on the first sheet 16A, although the box B may be placed in any location with respect to the aperture or window 18 located on the first sheet 16A of the backer panel 16. The box B contains a receptacle portion R and a lid portion L. The receptacle portion R, in one embodiment, contains four perimeter sides R1, R2, R3, R4 which extend upward from a bottom panel BP, creating an inner space into which items may be inserted and removed. A floor panel F may extend perpendicularly between the four perimeter sides R1, R2, R3, R4 of the box B portion and parallel to the bottom panel BP and creates a hidden compartment between the bottom panel BP and the floor panel F of the box B. The floor panel F may additionally contain four side panels F1, F2, F3, F4 which extend downward therefrom and which are used to stabilize the floor panel F atop the bottom panel BP of the box B and also to define the height of the hidden compartment between the bottom BP and floor F panels of the box B. Electronics, such as those described herein, may be contained within the hidden compartment. They may be attached directed to the bottom panel BP of the box or may be attached to a separate panel or insert that is inserted into the hidden compartment between the bottom BP and floor F panels of the box B. The floor panel F may contain a strip of adhesive 26 to secure a gift card GC within the box B. The floor panel may also contain a depressed portion 28 for containing a micro-gift G therein, such as those described above. Additionally, a display panel 30 may be inserted over the depressed portion 28 of the floor panel F to conceal a micro-gift G or a portion thereof. The display panel 30 may contain one or more slots or other windows or apertures thereon to facilitate attachment of a micro-gift G or a portion thereof. In another embodiment, the floor panel F may also contain two parallel slots thereon to facilitate attachment of a display panel thereto. The slots extend vertically upward from a bottom edge of the floor panel F. In one embodiment, the slots do not extend over the entire length of the floor panel F. A display panel 30 is attached between the floor panel F and the lid L. The display panel 30 is slanted or sloped in a downward direction, as an upper portion of the display panel 30 is attached to the lid L and a lower portion of the display panel 30 is attached to the floor panel F. A sleeve is attached to a bottom surface of the display panel 30, on an underside thereof. The sleeve is attached around a portion of the floor panel F via the slots in the floor panel F. The sleeve enables the display panel 30 to move along the length of the slots on the floor panel F as the lid L is opened and closed. For example, when the lid L is in a closed position, the display panel 30 is in a first position, in a lower portion of the box B, near the bottom edge thereof. In this first position (with the lid L closed) the display panel 30 is also located at an angle with respect to the floor panel F of the box B. When the lid L is in an open position, the display panel 30 moves to a second position, wherein it moves away from the bottom edge of the box B along the slots on the floor panel F. In this second position (with the lid L open) the display panel 30 is also located at an angle with respect to the floor panel F of the box B, the angle being greater than the angle it is at with respect to the floor panel F when it is in the first position (with the lid L closed). The display panel 30 may also contain one or more apertures, openings or slots thereon which facilitate attachment of a micro-gift G thereto. For example, the display panel 30 may contain two openings thereon for the attachment of a necklace therethrough. Other apertures, openings, slots or other attachment mechanisms may be a part of the display panel 30, depending on the type or configuration of the micro-gift G that is to be attached thereto. The display panel 30 may also have a pocket attached to a bottom surface thereof for containment of the micro-gift G therein. In one embodiment, the pocket is a clear, three-sided, open-topped pocket. A micro-gift G can easily be inserted into and removed from said pocket, and the clear nature of the pocket allows visibility of a micro-gift G contained therein. In one embodiment, a gift card panel is also contained within the box B which contains a gift card pocket for containing a gift card therein. The gift card panel may contain a main panel with three side panels extending downward therefrom. The gift card panel is operative to be placed over a portion of the display panel at a bottom portion of the receptacle portion of the box. When the display panel 30 is in a first position (with the lid L closed) the gift card panel covers or conceals the pocket contained on the display panel 30 for insertion and removal of a micro-gift G therein. When the display panel 30 moves to the second position (when the lid L is opened), the pocket on the display panel 30 moves into view above the gift card panel. The gift card panel also covers the slots contained on the floor panel F (along which the display panel 30 is able to move) so this feature is not visible to the gift card/gift recipient. The gift card panel also contains a pocket thereon for the insertion and removal of a gift card GC. In one embodiment, the pocket is a clear, three-sided, open-topped pocket. A gift card GC may be easily inserted and removed from the pocket and the clear nature of the pocket allows visibility to a gift card GC contained therein. As mentioned above, the display panel 30 (to which a micro-gift G is attached) is attached to both the lid and the receptacle portion of the box. The display panel is attached to a lower inside portion of the lid via glue or other attachment mechanism. Attachment of the display panel to the lid allows movement of the display panel, as described above, when the lid is moved from a closed position to an open position, and vice-versa. The receptacle portion R of the box B may additionally contain a pop-up structure or other three-dimensional element or structure therein. The lid portion L of the box B is sized to fit over the receptacle portion R of the box B. In one embodiment, the lid L is attached to the receptacle portion R of the box B along a top edge thereof and therefore contains three perimeter side panels (right side L2, left side L3, bottom side L1). Two of the perimeter side panels (right L2 and left L3) at least partially cover the two sides R2, R4 of the box B and a lower perimeter side panel (bottom) L1 at least partially covers the bottom or lower perimeter side R1 of the receptacle portion R of the box B. The two side perimeter panels L2, L3 of the lid L may be tapered from front to back, to facilitate easy opening and closing of the lid L atop the receptacle R and/or the bottom perimeter panel L of the lid L may contain a notch or cutout thereon for easy removal of the lid from the receptacle. Alternatively, the lid may be completely removable from the receptacle portion R of the box B, having four perimeter side edges (right side R2, left side R4, bottom side R1, top side R3). The lid L may be in a closed position when the it is atop the receptacle portion R of the box B. The size of the lid L (width and height) is slightly larger than the receptacle portion R of the box B as it is intended to fit snugly over the receptacle R as in a friction fit. The lid L can be in a closed position, wherein it is placed atop the receptacle portion R of the box B, closing the box B and concealing the contents therein. The lid L is moved to an open position by removing the lid L from the receptacle portion R of the box B. In the case of a hinged (or attached) lid L, the lid L is opened by lifting the bottom portion L1 of the lid L upward to hinge along the top portion of the box B. In the case of a completely removable lid L, the lid is opened by lifting any perimeter side of the lid and removing it from atop the receptacle portion of the box. The underside of the lid may also contain a pop-up structure or other three-dimensional element or structure. Both the receptacle and lid portions of the box can have printing or other indicia or embellishments printed thereon or attached thereto. The box B may be as described directly above or may be as described in any of the themed gift card and gift card holder combinations described herein. Alternatively, the box B may be empty or may contain any number and combination of box inserts to facilitate securement of a gift card and possibly a micro-gift therein.

The box B may contain a sound module which is operative to store and playback at least one audio file through a speaker. The components of the sound module may include, but are not limited to: an electronic circuit with integrated circuit chip and controller 38, a power source such as one or more batteries 40, a speaker 36, a memory device (may be part of integrated circuit chip) onto which at least one audio file is saved, a switch, various wires and circuitry which connect various components, and any other component which is required for or which facilitates playing audio through a speaker 36. Such components, in one embodiment, may be contained within the hidden compartment between the bottom BP and floor F panels of the receptacle portions R of the box B. In one embodiment, the switch, which controls activation of the audio playback is a light sensitive switch. When the lid L is removed from the receptacle portion R of the box B, the light sensitive switch is triggered causing audio playback through the speaker 36. In other embodiments, the switch may be a slide switch, a magnetic switch, a contact switch, a touch-sensitive switch, or any other suitable switch mechanism. The audio may play through the speaker 36 for a pre-determined amount of time, such as, for example, 25 seconds. If the audio is initiated upon removing the lid L from the receptacle portion of the box then placing the lid L back onto the receptacle R while the audio is still playing, may cease audio playback. In other embodiments, the audio will replay until the pre-determined playback time is elapsed, regardless of whether the lid L is replaced upon the receptacle portion R of the box B. In alternate embodiments, the box B may additionally contain a microphone or recording device which allows a user to record and save a personal message to be replayed to the recipient upon activation of the switch. In other embodiments, the box B may contain alternative or additional features, such as illumination of one or more lights, or motor movement of one or more mobile objects contained in or on the box (referred to collectively, along with audio capabilities, as "special effects").

Figure 20:
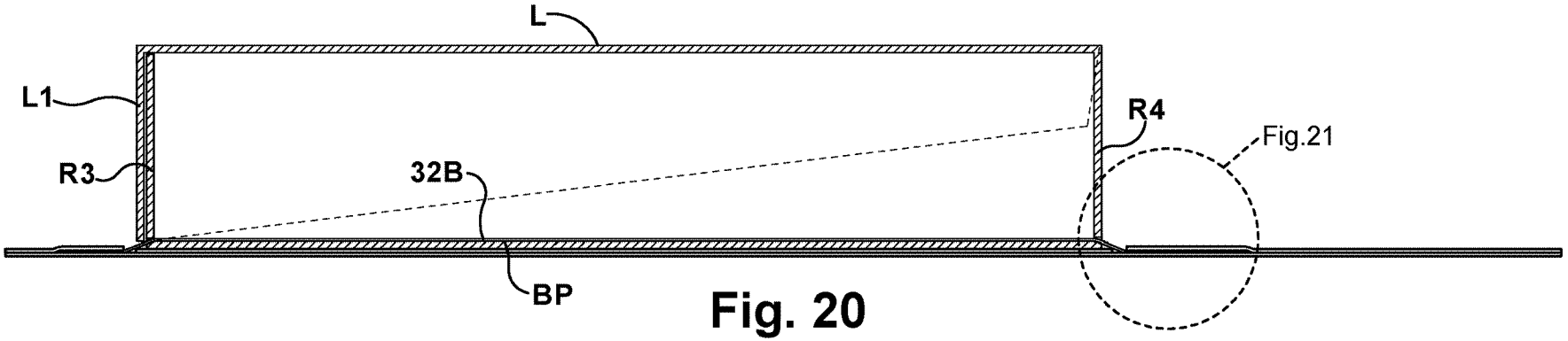
FIG. 20 is a side view of the packaging for a THEMED GIFT CARD AND GIFT CARD HOLDER COMBINATION of FIG. 16.
Figure 21:
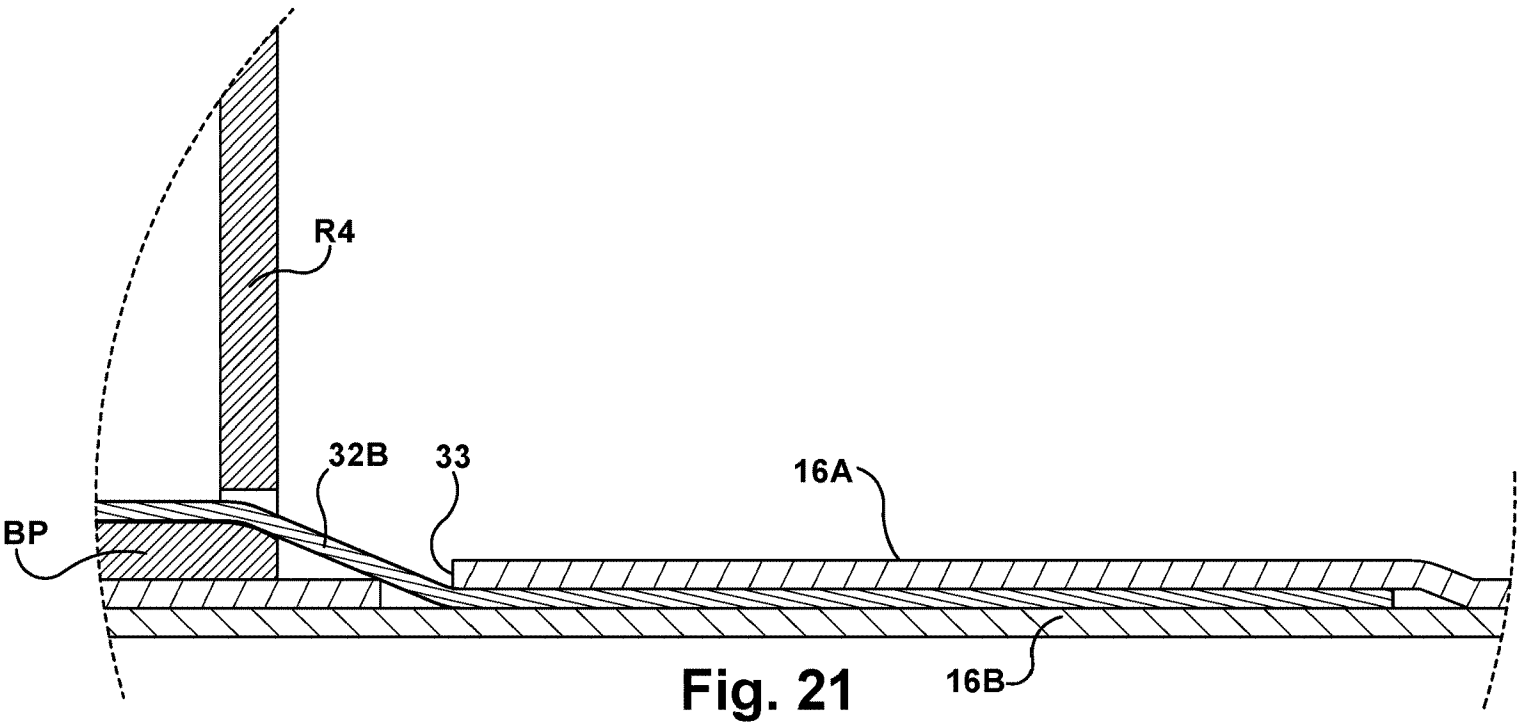
FIG. 21 is a close-up view of a portion of FIG. 20, showing the attachment of the gift card holder to the backer panel.

As noted above, and shown in FIGS. 20 and 21, the box B is attached to the backer panel 16 by the use of one or more bands or straps 32. The one or more bands or straps 32 contain a first end and a second end located opposite the first end. The first and second ends of the one or more bands or straps 32 are secured between the first and second sheets 16A, 16B of the backer panel 16. The first end of the one or more bands or straps 32 is secured between the first and second sheets 16A, 16B of the backer panel 16 in an upper portion thereof (via a slot or opening in the first sheet of the backer panel 16). The one or more bands or straps 32 are then inserted into the receptacle portion R of the box B via a slot or opening in the top or upper perimeter panel, as shown in FIG. 21. The one or more bands or straps 32 then run parallel along the bottom panel of the receptacle portion R of the box B. The one or more bands or straps 32 then exit the receptacle portion R of the box B via a slot or opening in the bottom or lower perimeter panel. The one or more bands or straps 32 are then inserted back between the first and second sheets 16A, 16B of the backer panel 16 in a lower portion thereof (via a slot or opening in the first sheet 16A of the backer panel 16). In one embodiment, there are two bands, a first band 32A which runs inside the box B along a left side thereof and a second band 32B which runs inside the box B along a right side thereof.

A gift card GC is placed into the space between the first and second sheets 16A, 16B of the backer panel 16 prior to display at retail by lifting the flap 20 on the second sheet 16B of the backer panel 16 and placing the gift card GC therein such that the front face of the gift card GC is visible through the aperture or window 18 in the first sheet 16A of the backer panel 16 (and transparent material 23) and the rear face of the gift card GC is visible through the aperture or window 22 on the second sheet 16B of the backer panel 16, the flap 20 (and transparent material 31). A strip of adhesive 34 is contained on the second sheet 16B of the backer panel 16 beneath the aperture or windows 18, 22 located on the first and second sheets 16A, 16B of the backer panel 16 so that the gift card GC can be inserted and secured therein prior to display at retail (by securing the flap 20 to the adhesive 34). The aperture or windows 22, 29 on the second sheet 16B of the backer panel 16 and flap 20, which expose the rear surface the gift card GC, allows the gift card GC to be activated and/or loaded at retail without removing the gift card GC from the packaging 100 or damaging the packaging 100. The first and second sheets 16A, 16B of the backer panel 16 may additionally contain a dashed line or cut line 33 positioned horizontally along the width of the backer panel 16 below the gift card GC and above the box B. Once a consumer has purchased the gift card/gift card holder/micro-gift combination product 100, he/she can use a pair of scissors to cut the backer panel 16 along the dashed or cut line 33. This will also cut or sever the bands or straps 32 which are holding or securing the box B to the backer panel 16 and also provide an opening through which the gift card GC may be removed from between the first and second sheets 16A, 16B of the backing panel 16.

Attachment of the gift box to the backer panel allows the user to experience the product at retail. The lid of the box can be freely opened and closed so consumers are free to experience any special effects (audio, light, motor movement) and also to view the contents of the gift card holder box (micro-gift, pop-up structure). The box and gift card are securely attached to the backer panel and the micro-gift is securely attached to the gift card holder (box). Therefore, the entire gift card/gift card holder/micro-gift combination product can be sold as a single product at retail.

Bundled Package with Slide-Apart Container as Gift Card Holder

In another embodiment, the gift card holder GCH is a slide-apart container, as described herein. This packaged bundle provides allows the user to view the gift card holder GCH and gift card GC through a transparent blister or vacuum formed molded plastic.

The structure includes a backer panel 17 and a transparent blister or vacuum formed molded plastic 50. The backer panel 17 contains a first sheet 17A and a second sheet 17B which, in one embodiment, are substantially equal in size, substantially rectangular in shape and having four perimeter sides including a top side TS, a bottom side BS opposite the top side TS, a right side RS, and a left side LS opposite the right side RS. The first and second sheets 17A, 17B are attached at least along a top side TS thereof. The first sheet 17A of the backer panel 17, which serves as the front of the gift card packaging 200, contains, in one embodiment, a first aperture 45 and a second aperture 46. The first aperture 45 is a rectangular shaped opening, generally the same size as a traditional gift card, having an approximate 3⅜-inch width and an approximate 2⅛-inch height. The first aperture 45, in one embodiment is horizontally centered in an upper region of the first sheet 17A of the backer panel 17, proximate to the top side TS of the backer panel 17. The first aperture also contains a transparent plastic or acetate panel or sheet 19 beneath which a gift card is inserted. The second sheet 17B of the backer panel 17, which serves as the back or rear of the gift card packaging 200, contains an aperture 47 thereon which is identical in size and location of the first aperture 45 on the first sheet 17A of the backer panel 17. A flap 21 is placed over the apertures 45, 47 on the first and second sheet 17A, 17B of the backer panel 17. The flap 21 contains four sides, at least one of which (preferably the top side), is attached to or integral with the second sheet 17B of the backer panel 17. The flap 21 contains an aperture 49 thereon in the shape of a rectangle which is horizontally centered thereon. The aperture 49 on the flap 21 also contains a transparent plastic or acetate panel 27 thereon. When a gift card GC is positioned within the space between the first and second sheets 17A, 17B of the backer panel 17, the front face of the gift card GC is visible through the aperture or window 19 on the first sheet 17A and the rear face of the gift card GC is visible through the aperture in the second sheet 17B of the backer panel 17 and the flap 21. The first and second sheets 17A, 17B of the backer panel 17 may additionally contain an aperture or opening 25 in a top portion thereof which facilitates the suspension of the entire packaging 200 from a rod or hanger.

Figure 22:
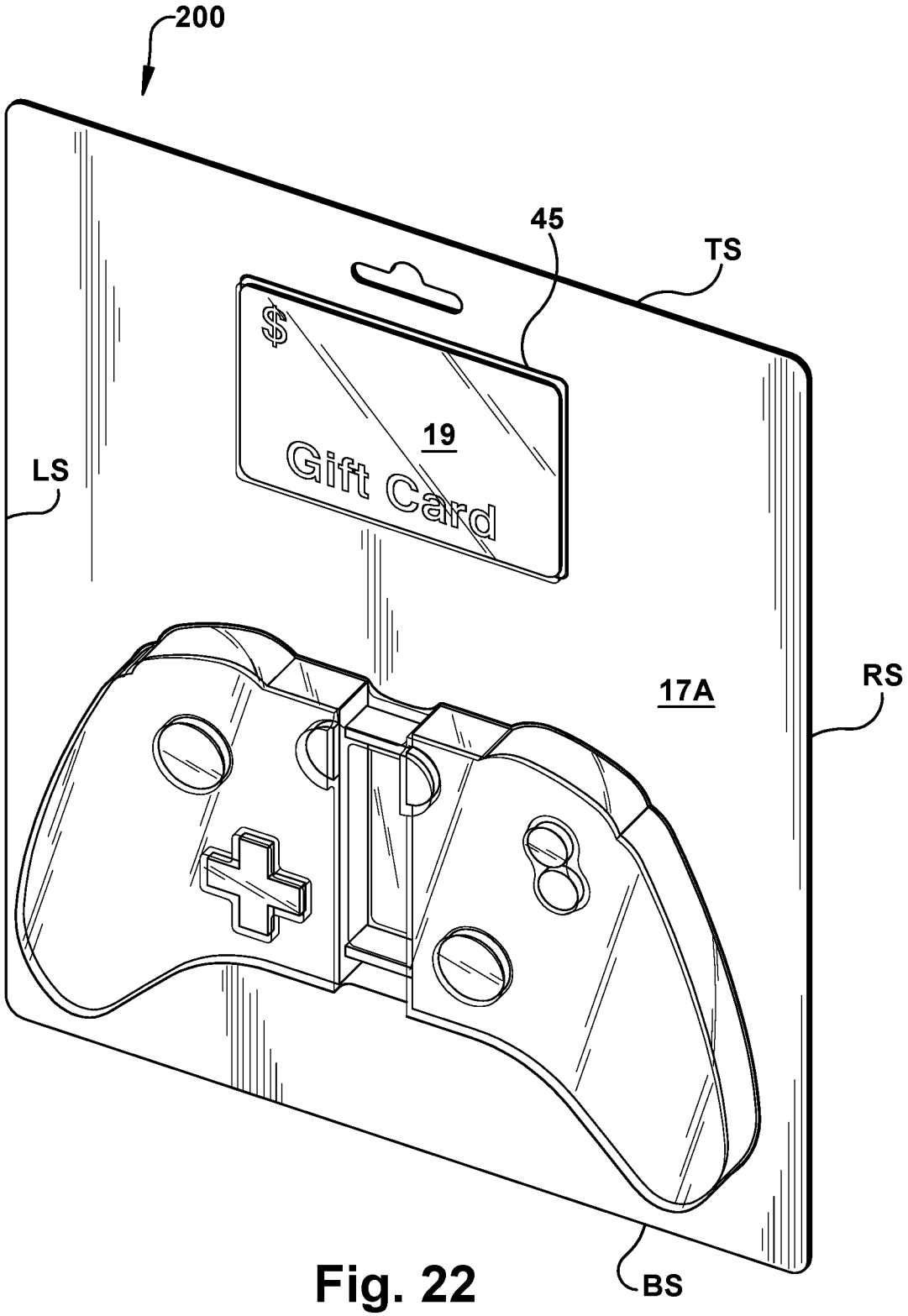
FIG. 22 is a front perspective view of a second embodiment of the packaging for a THEMED GIFT CARD AND GIFT CARD HOLDER COMBINATION.
Figure 23:
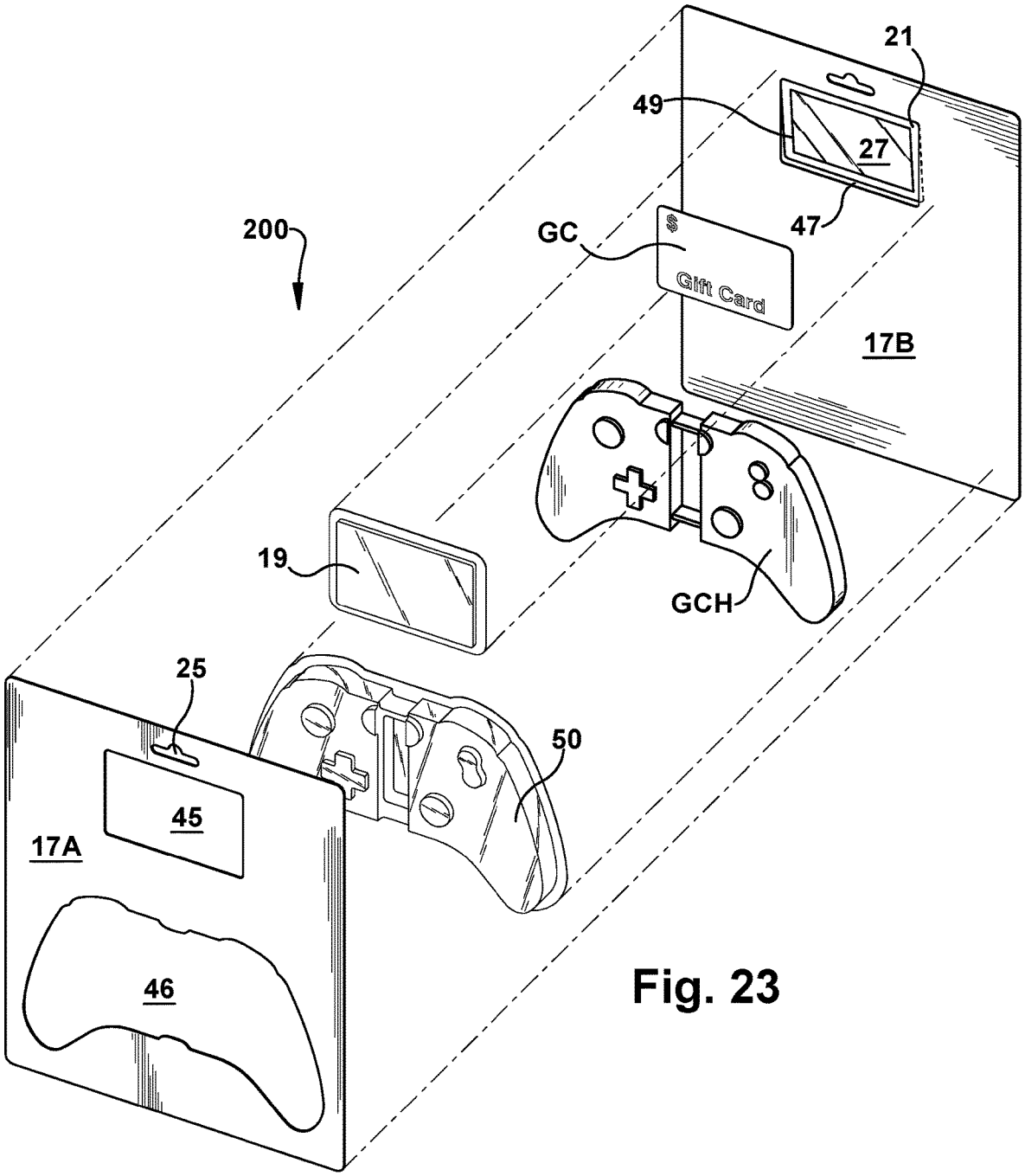
FIG. 23 is an exploded view of the packaging for a THEMED GIFT CARD AND GIFT CARD HOLDER COMBINATION of FIG. 22.

The second aperture 46 contained on the first sheet 17A of the backer panel 17, is shaped in the form of the slide-apart gift card holder GCH. For example, as shown in FIGS. 22 and 23, the slide apart gift card holder GCH is in the form of a replica game system controller. A pre-formed blister or vacuum formed plastic cavity 50, which is also shaped in the form of the slide-apart gift card holder GCH, is inserted into the second aperture 46 on the first sheet 17A of the backer panel 17, such that the cavity 50 protrudes outward from the first sheet 17A of the backer panel. The cavity 50 is transparent so the consumer can clearly see the gift card holder GCH contained therein. As shown in FIG. 23, the pre-formed blister or vacuum formed plastic cavity 50, the gift card holder GCH, and gift card GC, are inserted between the first and second sheets 17A, 17B of the backer panel 17. The first and second sheets 17A, 17B are then attached using adhesive or any other attachment material or mechanism.

A gift card GC is placed into the space between the apertures 45, 47 located on the first and second 17A, 17B sheets of the backer panel 17 prior to display at retail by lifting the flap 21 on the second sheet 17B of the backer panel 17 and placing the gift card GC therein such that the front face of the gift card GC is visible through the first aperture 45 on the first sheet 17A of the backer panel and the rear face of the gift card GC is visible through the apertures 47, 49 on the second sheet 17B of the backer panel 17 and the flap 21. A strip of adhesive 35 may be contained on the second sheet 17B of the backer panel 17 beneath the apertures 45, 47 on the first and second sheets 17A, 17B of the backer panel so that the gift card GC can be inserted and secured therein prior to display at retail. The apertures 47, 49 on the second sheet 17B of the backer panel 17 and the flap 21 (and transparent cover sheet material 27) make the entire rear surface of the gift card GC visible so the gift card GC may be scanned and activated at retail without removing the gift card or damaging the packaging 200.

While the above embodiments of the themed gift card/gift card holder combinations of the present invention have been described herein and shown in the figures as having a particular shape, being made of a particular material or materials, having various electronic capabilities, certain gift card presentation methods or devices, and containing gift cards from specific retailers, other shapes, materials, electronic capabilities, gift card presentation methods and devices, and gift cards have been contemplated and are considered to be within the scope of the present invention. The various features of each set of embodiments described herein can be interchanged among the different embodiments. Each set of embodiments may or may not include special effects as described herein.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. Packaging for a bundled gift card and gift card holder combination product comprising:

a backer panel, the backer panel having a front surface and a rear surface opposite the front surface, a transparent receptacle having a front surface and a rear surface opposite the front surface, the transparent receptacle contained between the front and rear surfaces of the backer panel;

a box attached to the backer panel by at least two straps, the box having a receptacle portion and a lid portion at least partially attached to the receptacle portion;

the at least two straps each having a first end and a second end, each first end being secured between the front and rear surfaces of the backer panel each first end being inserted through the receptacle portion of the box and then secured between the front and rear surfaces of the backer panel;

a gift card contained between the front and rear surfaces of the transparent receptacle contained on the backer panel.

2. The packaging of claim 1, wherein the box contains adhesive and a depressed portion.

3. The packaging of claim 2, wherein the box contains a sound module.

4. The packaging of claim 1, wherein the backer panel includes a dashed line printed thereon between the transparent receptacle and the box.

5. The packaging of claim 4, wherein cutting the backer panel along the dashed line releases the box from the backer panel and releases the gift card from within the transparent receptacle.

6. Packaging for a bundled gift card and gift card holder combination product comprising:

a backer panel, the backer panel having a first sheet and a second sheet attached to one another;

a container attached to the backer panel via two straps;

a gift card inserted between the first and second sheets of the backer panel;

wherein the two straps are secured, at each end, between the first and second sheets of the backer panel;

wherein the two straps are inserted into the container attached to the backer panel to secure the container thereto; and wherein the gift card and container may be removed from the backer panel and the gift card inserted into the container for presentation to a recipient.

7. The packaging of claim 6, wherein the container is a box.

8. The packaging of claim 6, wherein the gift card is contained in an aperture or window a transparent material located on the backer panel.

* * * * *